US008984829B1

(12) United States Patent
McIntosh et al.

(10) Patent No.: US 8,984,829 B1
(45) **Date of Patent: *Mar. 24, 2015**

(54) MODULAR FLOORING ASSEMBLIES

(71) Applicant: CoMc, LLC, Omaha, NE (US)

(72) Inventors: Jonathan McIntosh, Omaha, NE (US); Nicole Sperling, Lincoln, NE (US)

(73) Assignee: CoMc, LLC, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/159,025

(22) Filed: Jan. 20, 2014

Related U.S. Application Data

(63) Continuation of application No. 13/399,239, filed on Feb. 17, 2012, now Pat. No. 8,631,624.

(51) Int. Cl.
*E04F 15/22* (2006.01)
*E04F 15/02* (2006.01)

(52) U.S. Cl.
CPC ..... *E04F 15/22* (2013.01); *E04F 15/02044* (2013.01); *E04F 15/0215* (2013.01)
USPC ..... 52/403.1; 52/589.1

(58) Field of Classification Search
USPC ..... 52/403.1, 589.1, 177, 180, 181
See application file for complete search history.

(56) References Cited

U.S. PATENT DOCUMENTS

| | | | | | |
|---|---|---|---|---|---|
| 4,095,388 | A * | 6/1978 | Breault | 52/747.11 |
| 4,167,599 | A * | 9/1979 | Nissinen | 428/44 |
| 4,287,693 | A * | 9/1981 | Collette | 52/177 |
| 4,590,731 | A * | 5/1986 | DeGooyer | 52/581 |
| 5,190,799 | A * | 3/1993 | Ellingson, III | 428/53 |
| 5,950,378 | A * | 9/1999 | Council et al. | 52/177 |
| 6,098,354 | A * | 8/2000 | Skandis | 52/177 |
| 8,631,624 | B2 * | 1/2014 | McIntosh et al. | 52/589.1 |

* cited by examiner

*Primary Examiner* — Basil Katcheves
(74) *Attorney, Agent, or Firm* — Edwin A. Sisson, Attorney at Law, LLC

(57) ABSTRACT

A modular flooring assembly including a flooring component adhered to a tray substrate is described. The modular flooring assembly may be interconnected with additional modular flooring assemblies to form a modular floor suitable for most flooring applications. The flooring component may be tile or wood or other materials commonly used in flooring applications. Convention fill-in grout or a snap-in grout may be used with the modular flooring assemblies. One suitable snap-in grout is a right angle grout member.

16 Claims, 35 Drawing Sheets

MODULAR FLOORING ASSEMBLIES

PRIORITY AND CROSS REFERENCES

This application is a continuation of U.S. Non-Provisional patent application Ser. No. 13/399,239 filed 17 Feb. 2012 which is a continuation of U.S. Non-Provisional patent application Ser. No. 12/433,844 filed 30 Apr. 2009, which is now granted U.S. Pat. No. 8,146,319 which is a continuation of U.S. patent application Ser. No. 11/432,873 filed 12 May 2006, which is now granted U.S. Pat. No. 7,543,417, the teachings of each of which are incorporated in their entirety. This application also claims priority to U.S. Provisional Patent Application No. 60/723,578 filed Oct. 4, 2005 and to U.S. Provisional Patent Application No. 60/733,686 filed Nov. 4, 2005.

FIELD OF THE INVENTION

The present invention relates to a modular flooring assembly including a flooring component adhered to a tray substrate.

BACKGROUND OF THE INVENTION

Installing a conventional tile floor is a complicated procedure requiring expertise and craftsmanship. First, the existing flooring may have to be removed. Next, a concrete backer board is attached to the sub floor using permanent fixing means, such as screws or nails. Then, a grout compound is applied to the backer board. Tiles must then be immediately and precisely laid on the grout compound. After the grout on the backer board holding the tiles is hardened, additional grout must be applied between the tiles. This process may require several hours or days of drying time, during which time the floor must not be used.

Some previous attempts at modular flooring have not been fully successful. Some prior art modular flooring assemblies do not provide a full supporting structure for the flooring material. This may lead to failure of the flooring assembly as the flooring material may break or bend. Other prior art modular flooring assemblies do not securely hold the flooring material. Some prior art modular flooring systems allow the tiles to shift or migrate resulting in unacceptable performance.

SUMMARY OF THE INVENTION

The present invention relates to a modular flooring assembly including a flooring component adhered to a tray substrate. The modular flooring assembly may be interconnected with additional modular flooring assemblies to form a modular floor suitable for most flooring applications. The flooring component may comprise tile or wood or other materials commonly used in flooring applications. Convention fill-in grout or a snap-in grout may be used with the modular flooring assemblies. One suitable snap-in grout is a right angle grout member.

DETAILED DESCRIPTION OF PREFERRED EMBODIMENTS

Figure 1:
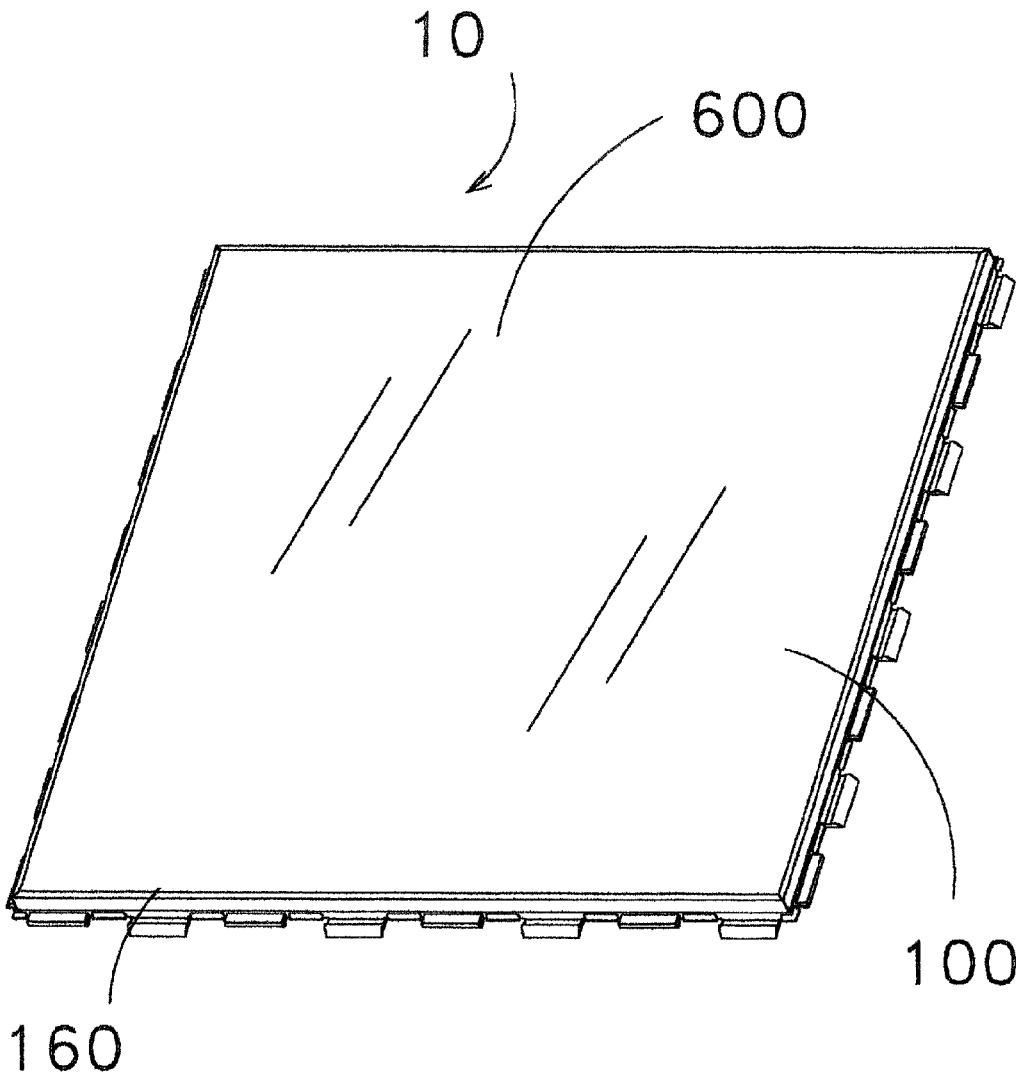
FIG. 1 shows a perspective view of the modular flooring assembly.

The present invention relates to a modular flooring assembly including a flooring component adhered to a tray substrate. The modular flooring assembly may be interconnected with additional modular flooring assemblies to form a modular floor suitable for most flooring applications. The flooring component may comprise tile or wood or other materials commonly used in flooring applications. The tray substrate comprises tabs, which provide for the tray substrates to interlock with tabs from an adjacent tray substrate. The fully assembled modular floor provides the appearance of a conventional floor. Fill-in grout or a snap-in grout may be used with the modular flooring assemblies. One suitable snap-in grout is a right angle grout member. The right angle grout member comprises inserts that are received by grout slots formed between the tabs.

Importantly, the modular floor may be assembled by individuals, who may lack the training and expertise to install a conventional floor. Also, the modular floor, according to certain embodiments of the present invention utilizing snap-in grout, may be installed without waiting for certain grout products to dry. Also, the modular floor may be quickly disassembled and does not damage the sub floor, as the modular floor is not typically attached to the sub floor by adhesives, grout compounds, or other fastening means. Further, the modular floor may be installed over an existing sub floor without the installation of a concrete backer board, which is commonly used in ceramic tile installation.

The tray substrate holds the flooring component on its tray surface. The tray surface is an upward facing horizontal surface with vertical tray edges which protrude upward around the perimeter of the tray surface.

The tray surface may be generally flat, or may contain a pattern designed to enhance adhesive performance between the tray surface and the flooring component. The tray surface pattern may be designed to complement the bottom of the flooring component; for example, tiles may have different mold patterns on their bottom depending upon the manufacturer's design. The tray surface may also be solid, or may have holes therein. The holes may be added in appropriate locations to aid in moisture evaporation without compromising adhesive performance.

The vertical tray edges are designed to ensure exact alignment of the flooring component with the tray surface, and provide a barrier to ensure adhesive can be applied over the entire bottom of the flooring component without the adhesive being pushed or flowing into the tab areas. If adhesive is allowed to enter the tab areas, their interlocking connection may be physically impaired by adhesive residue. The vertical tray edges preferably run the entire perimeter of the tray substrate.

By their vertical orientation, the tray edges positionally hold the flooring component and, in combination with the adhesive, reduce lateral movement. Importantly, the tray edges provide a further surface for the adhesive to adhere the flooring component. The tray surface joins to the bottom of the flooring component via the adhesive and the tray edges join to the sides of the flooring component via the adhesive. The combination of the adhesive on the tray surface and the adhesive on the tray edges provide a secure hold for the flooring component. This insures that the flooring component is locked down to the tray substrate, and the flooring component does not slip or move.

The size of the tray substrate and the flooring component are strictly controlled to insure that the flooring component fits securely in the tray substrate. The flooring component should just fit onto the tray surface and rest snugly against the vertical edges. The flooring component should be slightly smaller than the tray surface defined by the vertical tray edges.

The present invention achieves significant advantages. The tray has four vertical tray edges, which improve the structural rigidity of the tray. The four tray edges prevent adhesive from pushing into the interlocking tabs. In other systems, the adhesive can push into the tab area causing interference with the other tile. The four tray edges help align the flooring component to the tray, which improves assembly ease and quality. In other systems, the flooring surface is not constrained and therefore must be held in place until the adhesive has cured.

Snap-in grout may be used with the present invention. The snap-in grout is a solid material that fits in between the modular flooring assemblies. A preferred snap-in grout includes the right-angled grout member. The right-angle grout member includes a first leg integrally connected with a second leg at a right angle. Two such right-angle grout members are needed to fit around each modular flooring assembly. The right-angle grout member includes a plurality of inserts that are fitted into slots formed by the tabs. The inserts may have a triangle or arrow-shaped portion that is connected to the right angle grout assembly via a narrower transition region. The triangular-shaped portion may temporarily deform as it is inserted into the slot where it snaps into place.

The right-angle grout member provides many advantages. First, only two right-angles grout members are needs to fill in around one modular flooring assembly. This reduces the number of seams between the grout members and improves appearance. Secondly, the right-angle grout member provides a corner that wraps around the corner of the modular flooring assembly. This provides stability to the modular flooring system. Third, the right angle member is easier to install than straight linear strips of grout material since there are less grout pieces to work with.

The tabs are on the outside perimeter of the tray substrate. The tabs interlockingly connect the tray substrates. There are upward and downward facing tabs. The upward and downward tabs alternate on each edge of the tray substrate. For most flooring applications, the use of 6, 8, or 10 tabs per edge, half of each orientation, provide satisfactory performance. In other embodiments, there may be fewer or additional tabs.

The modular flooring assembly is designed such that even if one or more tabs are broken on a given side, the tray substrates will still interlock. This also allows the modular flooring assemblies to be cut to a specific size and to still interlock.

The interlocking tabs may be positioned such that the modular flooring assemblies are offset supporting various decorative patterns.

The interlocking tabs on one modular flooring assembly need not be perfectly aligned with the other modular flooring assembly to allow "fine-tuning" of the relative tile position.

The bottom of the tray, i.e., opposite of the tray surface, is designed as the foundation of the system. The bottom may include structural webbing to strengthen the tray bottom ensuring the tray surface remains relatively flat.

The bottom of the tray may also include an optional non-skid and noise deadening padding of an over-molded, rubber-like material, such as thermoplastic rubber or thermoplastic elastomer. A particularly preferred thermoplastic elastomer is Santoprene SANTOPRENE®. The padding provides a cushion for the flooring system. The padding also provides a non-skid element that prevents the flooring system from sliding on the underlying flooring material. The padding also provides some level of flex in the presence of underlying floor surface imperfections or heavy surface loads. The padding also helps reduce vibration transmission, thus providing a sound-deadening function.

As described above, various type of grout may be used in the present invention, including the snap-in grout or a fill-in grout compound that is spread into the gaps between neighboring trays.

The snap-in grout includes a snap-in locking mechanism. The snap-in grout is preferably made from thermoplastic elastomer, thermoplastic rubber, or other compressible, pliable, sealing material designed to fit between the tray substrates and provide a dust and moisture barrier.

In some embodiments, the snap-in grout fits into slots created by the interlocking tabs. Grout holders on the perimeter of the tray substrate may also be used in receiving the snap-in grout and in forming the slots.

In other embodiments, the snap-in grout is designed to fit into grout holes formed in the interlocking tabs. Both the upward and downward tabs have grout holes. When the tabs are interconnected, the grout holes overlap and provide a combined grout hole to receive the snap-in grout. The snap-in grout is locked into place with the snap-in locking mechanism. The snap-in grout may fit into grout holes on each tab, or in every other tab, or in a pre-defined pattern. The grout hole is generally positioned in the middle area of each tab and is designed to accommodate the snap-in grout line. When the upward and downward tabs are aligned, the grout component fits through the hole and then slides into place locking the grout line down and helping to secure the relative position of the tiles. The bottom of the grout hole may have a serrated surface matching to a serrated surface on the grout material.

Fill-in grouts may also be used with the trays. Fill-in grouts may be packaged in a powdered or granular form. The user mixes the powder or granules with a liquid to form a plastic material that is spread in between the modular flooring assemblies. Other fill-in grout compounds are packaged in a ready to spread form. The modular flooring assemblies are snapped together, and the fill-in grout material is used to fill the space between the modular flooring assembly. The fill-in grout material must remain semi-flexible once cured since the floor "floats." The separate grout material must also have good adhesive qualities to ensure the material adheres to the sides of the modular flooring assemblies.

Several different combinations of grout and methods of use may utilized with the modular flooring assemblies, including:

A snap-in grout, which is received by grout holes on each tab or in grout slots between the tabs.

A fill-in grout compound used with tabs having grout holes or forming grout slots. This embodiment provides manufacturing efficiencies since the same tray substrate can be used for both snap-in grouts and fill-in grouts.

A fill-in grout compound used with tabs without grout holes. Without the grout holes, the tabs are incrementally stronger—for applications where a fill-in grout compound will be applied, there is no reason to have the grout holes.

Snap-in grout with reduced number of grout holes or slots. In this alternative, the tabs with grout slots are reduced.

The flooring component may comprise tile, stone, marble, wood, or other conventional flooring materials. The flooring component could be a ceramic or porcelain tile, a natural stone product like marble or granite, or could be a wooden product.

The flooring component is adhered to the tray surface and tray edges using a variety of commercially available adhesives. Suitable adhesives for use with the present invention include a two-part epoxy using a methacrylate material. Other urethane adhesives may also be utilized. The specific selection of the adhesive will depend on the nature and properties of the flooring component. The methacrylate adhesive is preferred for ceramic tile. The tray edges define a space to receive the flooring component.

The present invention, by using a snap-in grout that is not permanently integrated with the tray, achieves advantages. The consumer may choose from among many different snap-in grout colors. Damaged snap-in grout can be easily replaced. Snap-in grout may also be changed to reflect different decorating tastes. Finally, flexibility is provided to either use snap-in grout or a fill-in grout.

The tray may be made using injection molding of a suitable plastic resin. High impact polystyrene is preferred, but other plastic resins including polypropylene and ABS may be used.

The padding of the non-skid and noise deadening material may be a thermoplastic rubber, thermoplastic elastomer, or other softer plastic material including Santoprene SANTOPRENE®. The padding is over-molded to the base of the tray. An adhesive is applied between the tray surface and the bottom of the flooring surface.

Multiple adhesive materials and application patterns can be used depending upon the combination of plastic resin used for the tray, the flooring material, and the profile of the flooring material. For tile application, adhesive is applied to the ridgelines on the bottom of the tile to maximize contact with the tray surface. Robotics may be used to improve the precision and efficiency of the assembly process. Robotics may also be used to package and palletize the finished products.

The modular flooring assemblies of the present invention may be used in 6-inch, 6½-inch, 12-inch, and 13-inch embodiments. The modular flooring assemblies have a square or rectangular shape. The square shaped modular flooring assemblies have four sides of equal length. Other sizes may be used, however these sizes are generally used in the flooring industry. Further, a combination of the 6-inch and 12-inch modular flooring assemblies may be used in combination to provide a unique appearance. The present invention may be further modified to include other combinations of different sized modular flooring assemblies.

During use of the present invention, the modular flooring assemblies are snapped together to form an overall flooring surface. The fill-in grout material may be applied between the modular flooring assemblies, or the snap-in grout may be installed. In order to accommodate different rooms of varying sized and shapes, the modular flooring assemblies can be cut using a wet saw if tile or stone is the flooring component or using a table or a circular saw for wooden flooring components.

The underlying flooring surface should be free of major surface variations, but need not be in perfect condition. No special floor preparation is required to ensure the tiles are fixed since the interlocking modular flooring assemblies will "float" and flex. The system can be installed directly on top of finished wood, linoleum, other tile, concrete, plywood, or a variety of other flooring systems. The modular flooring assemblies can be installed on top of padding or other underlayment material if an additional measure of insulation or padding is desired. The modular flooring assemblies can be installed on top of radiant-type heating systems as well.

Figure 2:
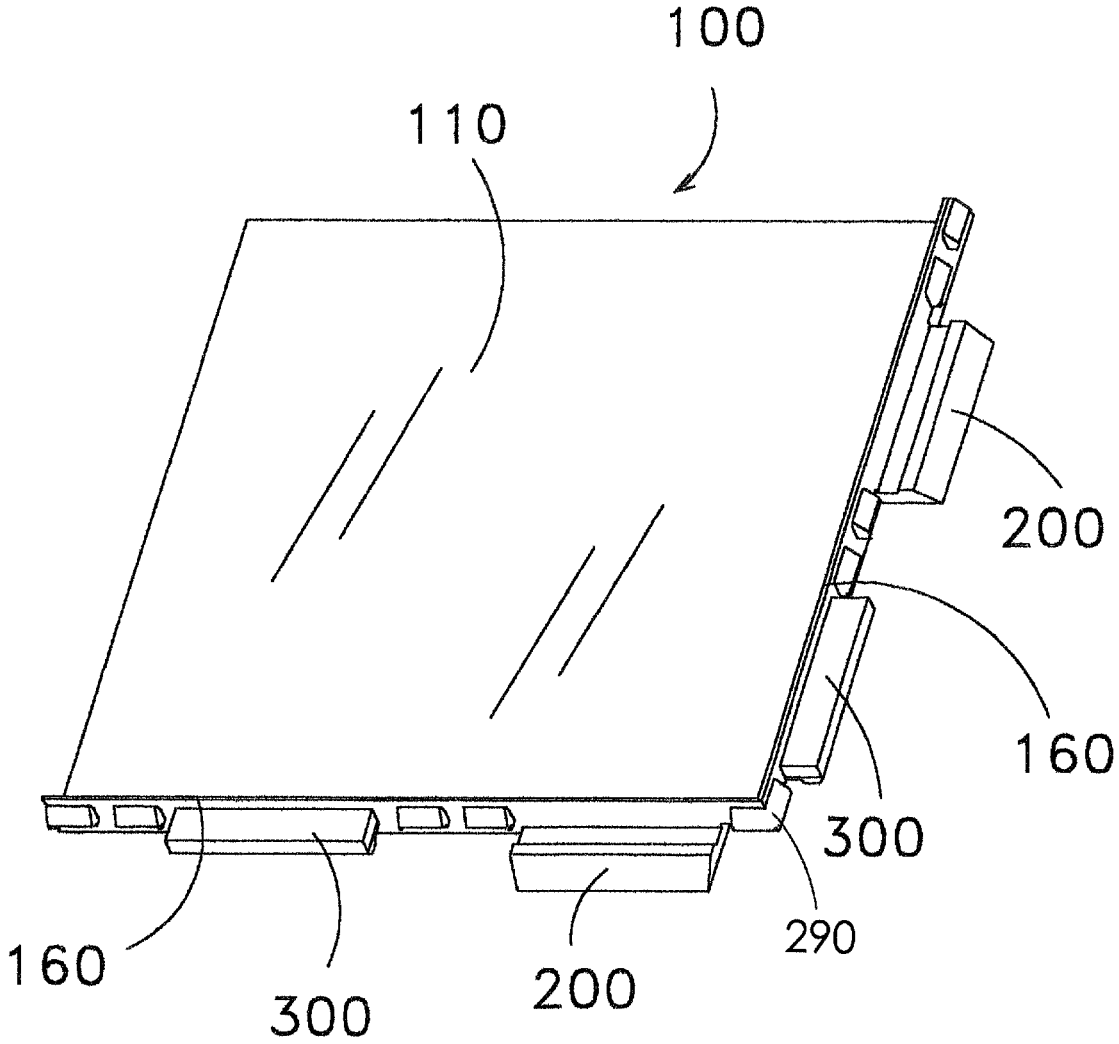
FIG. 2 shows a partial view of the tray.
Figure 3:
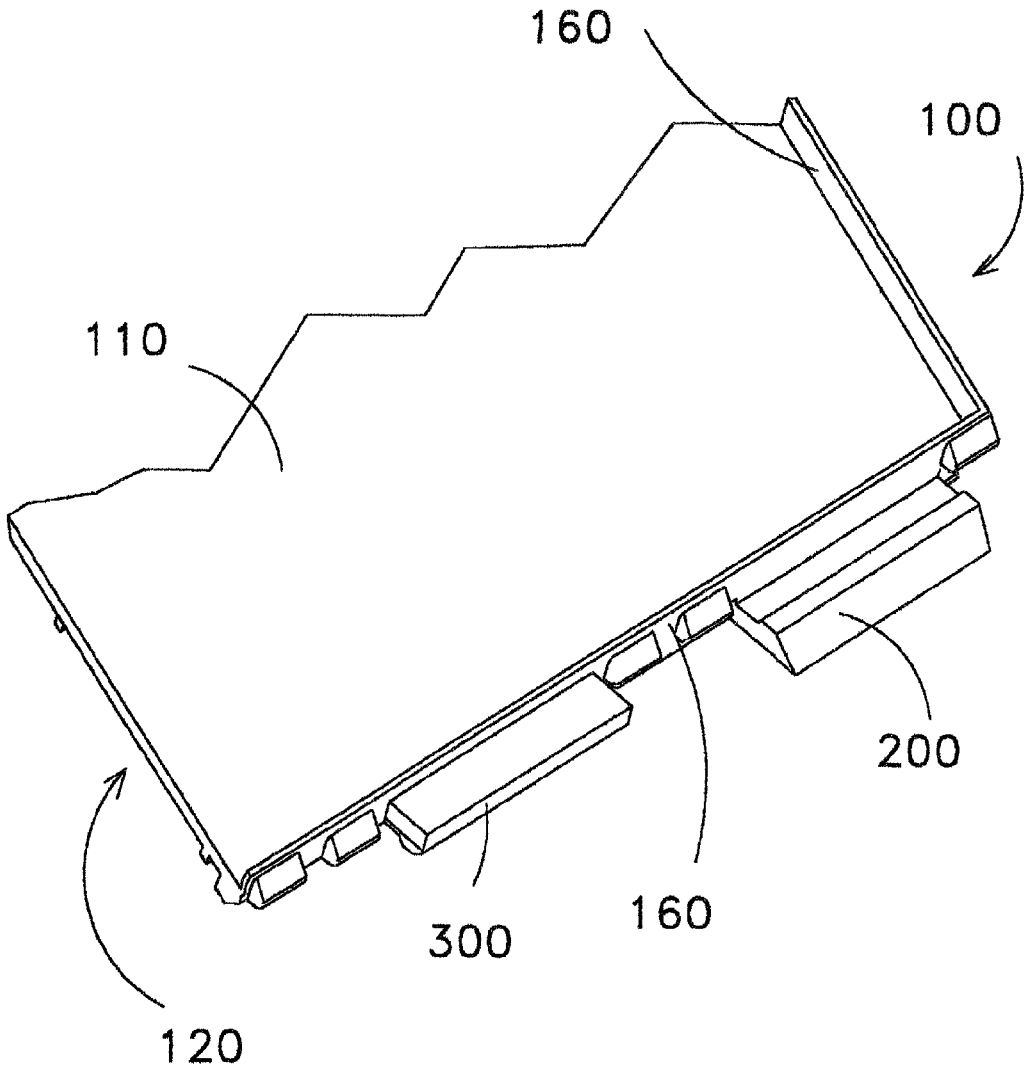
FIG. 3 shows a perspective, partial view of the tray.
Figure 4:
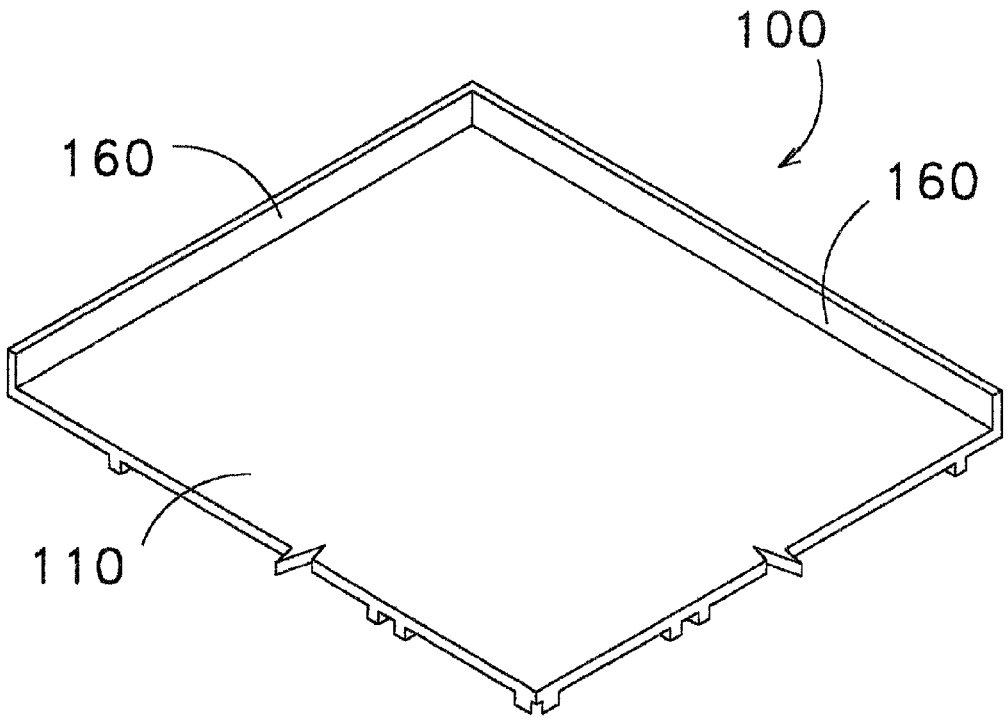
FIG. 4 shows a perspective, partial view of the top surface of the tray.

The present invention will now be described with reference to the Figures:

A first embodiment using a snap-in grout is shown in FIGS. 1-22. A modular flooring assembly 10 is shown in FIG. 1. The modular flooring assembly 10 includes a tray 100 with a flooring component 600 adhered thereto. FIGS. 2-4 show a partial view of the tray 100 with the flooring component 600 removed. The tray 100 has a tray surface 110 and a tray bottom 120. The tray surface 110 receives the flooring component 600, which in this embodiment is a ceramic tile.

Figure 5:
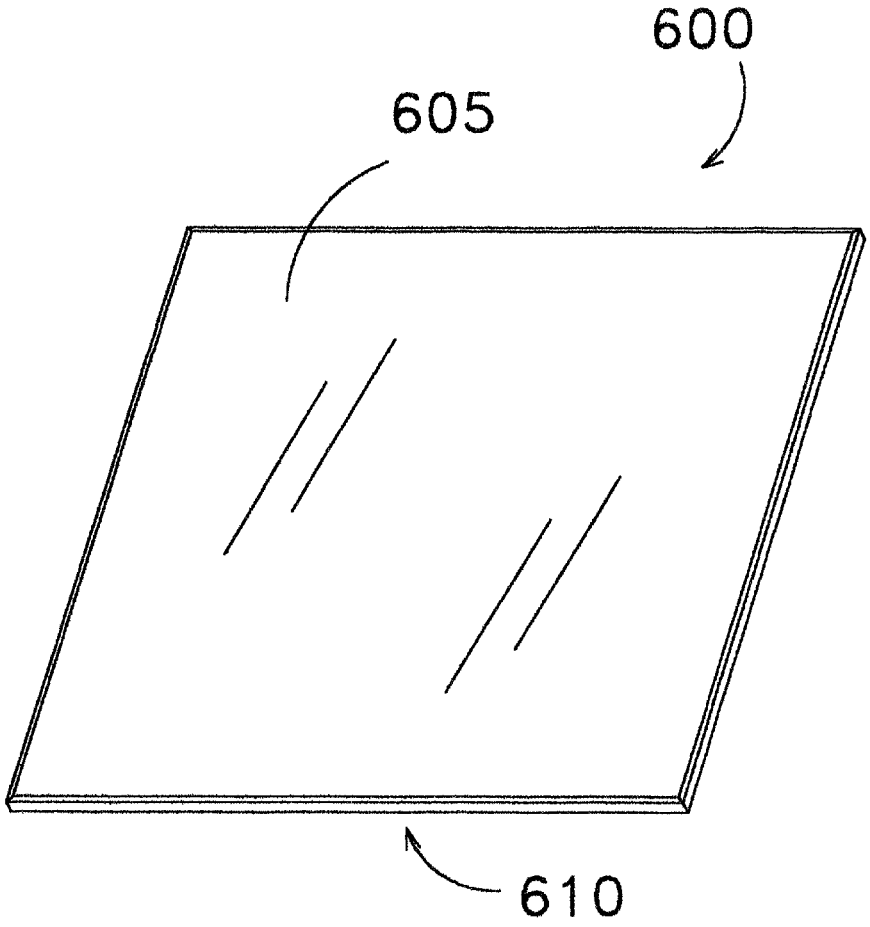
FIG. 5 shows a perspective view of the flooring component.

FIG. 5 shows the flooring component 600. A top surface 605 of the flooring component 600 forms the floor surface. A bottom surface 610 of the flooring component 600 is adhered to the tray surface 110 by an adhesive. Although in this embodiment the flooring component 600 is a ceramic tile, the flooring component may be made from any conventional flooring material.

Raised edges 160 of the tray surface 110 help secure the flooring component 600 and prevent adhesive from leaking from the tray surface 110. The raised edges 160 are shorter than the height of the flooring component 600. Preferably the raised edges 160 completely surround the flooring component 600.

A perimeter of the tray 100 is provided with a plurality of upward tabs 200 and a plurality of downward tabs 300. The upward tabs 200 interact with downward tabs 300, and the downward tabs 300 interact with the upward tabs 200 on an adjacent modular flooring assemblies 10. This provides the interconnection between adjacent modular flooring assemblies 10.

In this embodiment, the tray 100 is provided with a total of eight upward tabs 200 and downward tabs 300 per side of the tray 100. The tray 100 is designed to form a 12-inch flooring assembly, and more or less tabs may be utilized in larger modular flooring assemblies 10 and smaller modular flooring assemblies 10.

Figure 6:
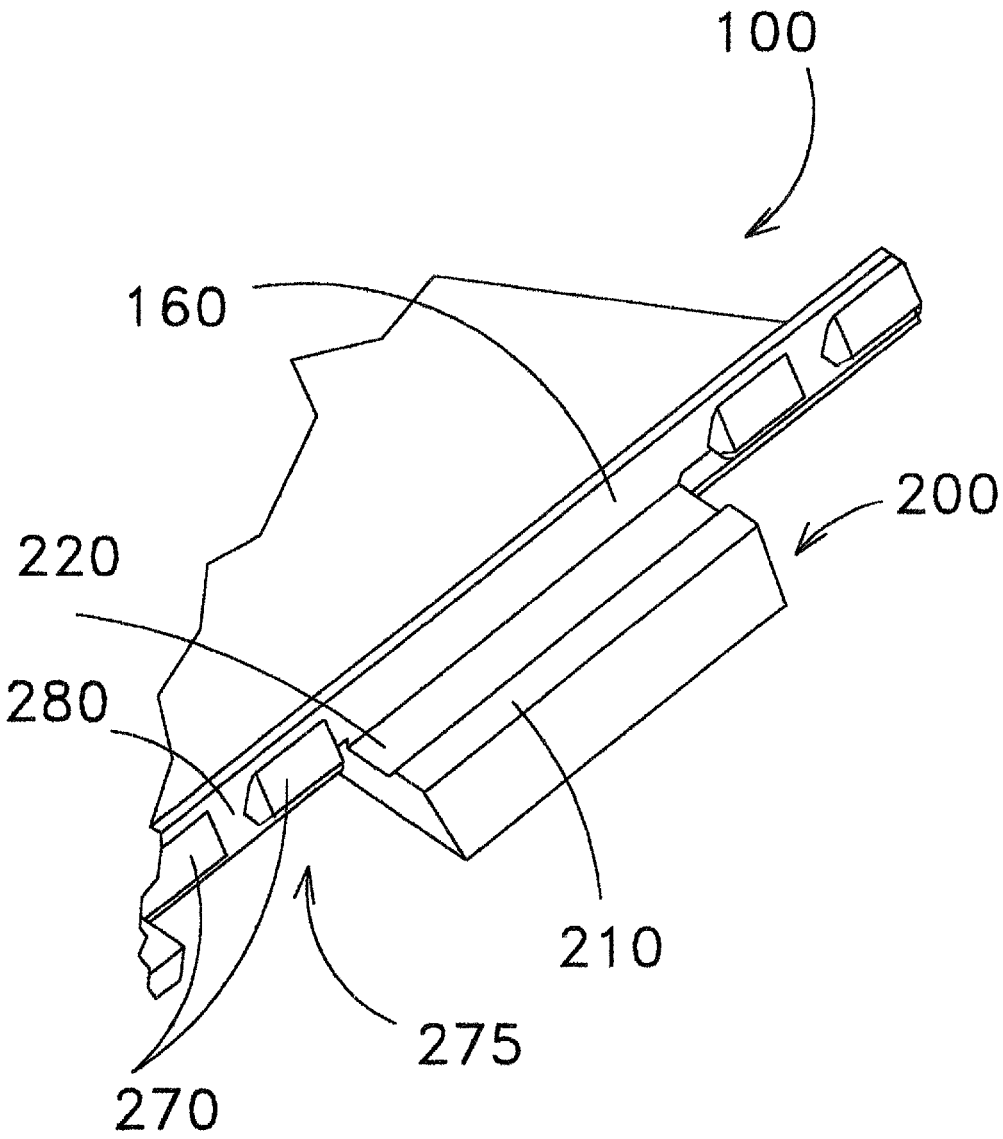
FIG. 6 shows a close-up view of the upward tab.
Figure 7:
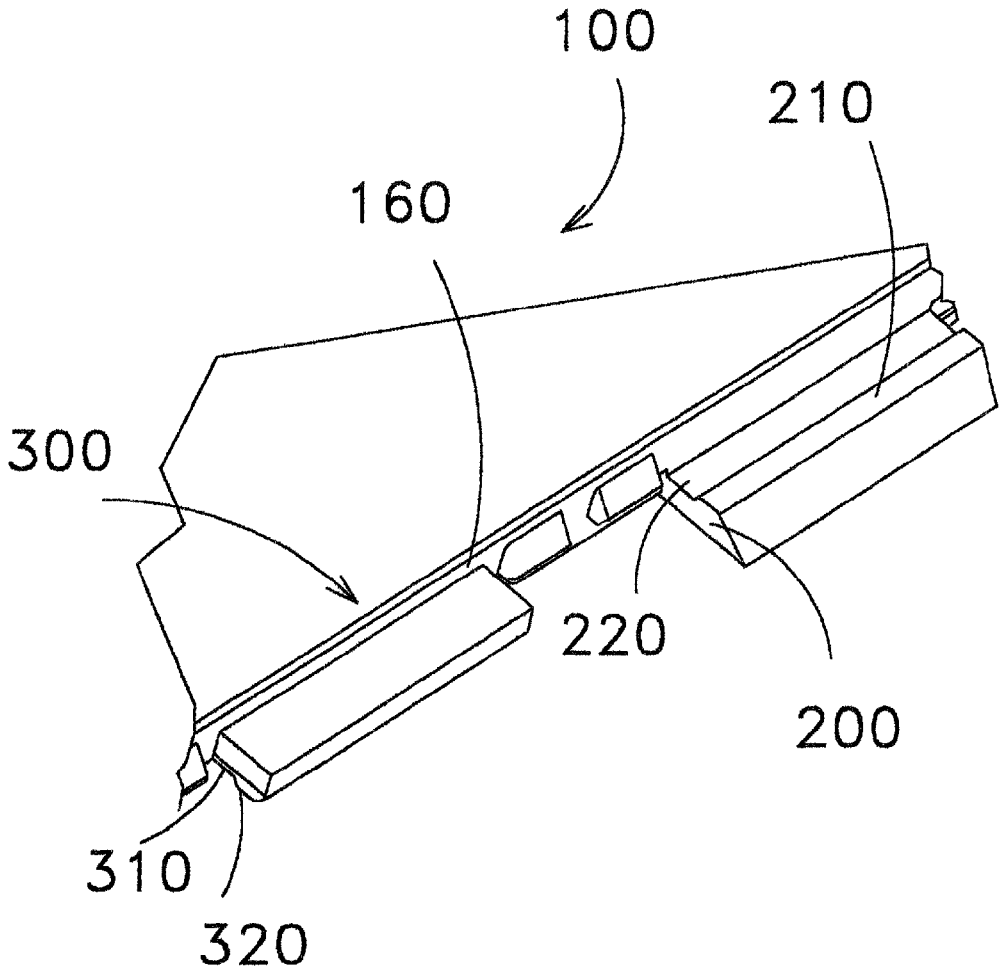
FIG. 7 shows a close-up view of the downward tab and the upward tab.
Figure 8:
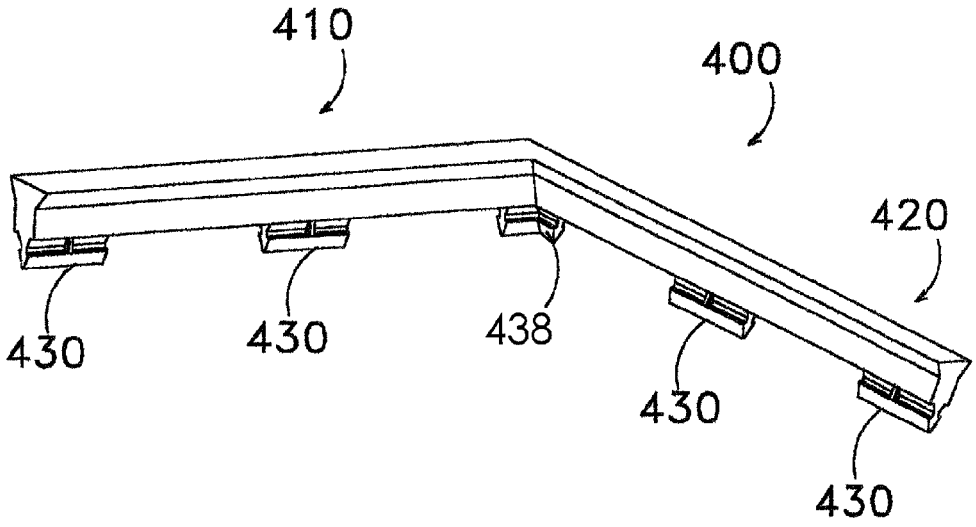
FIG. 8 shows a perspective view of the right angle grout member.

As shown in FIG. 6, the upward tab 200 includes a convex protrusion with a flat surface 210 and a valley 220. As shown in FIG. 7, the downward tab 300 includes a concave flat surface 310 and a lip 320. As the downward tab 300 is urged against the upward tab 200, the downward tab 300 flexes as the lip 320 slides over the convex flat surface 210 and into the valley 220, such that the lip 320 snaps into the valley 220 and the concave flat surface 310 presses over the convex flat surface 210. This provides a connection with sufficient rigidity to create a composite floor made of multiple modular flooring assemblies 10.

Figure 35:
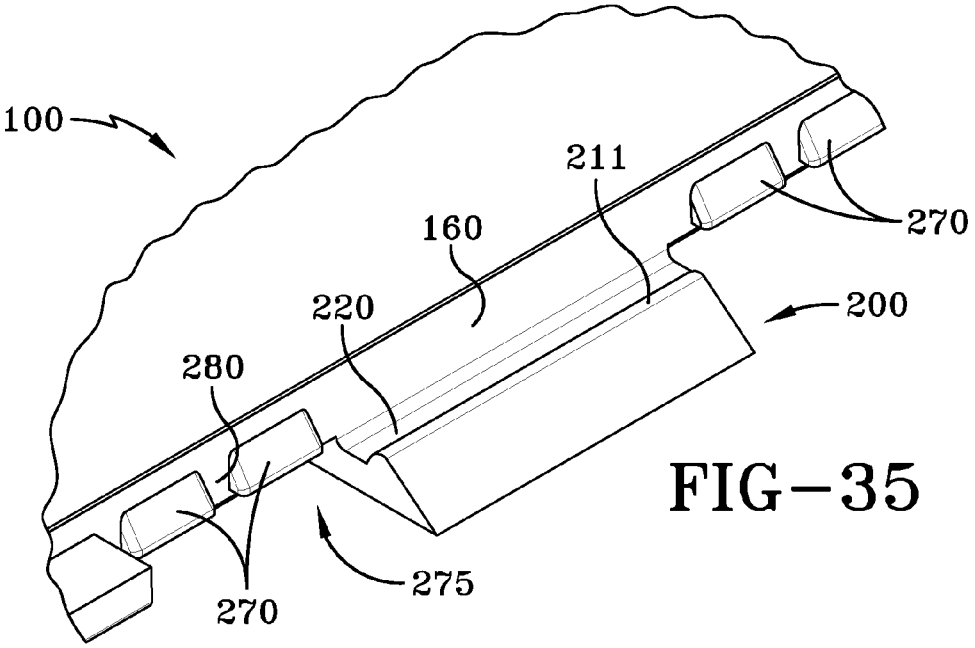
FIG. 35 shows an embodiment of the tray tabs with an upward tab having a convex surface.
Figure 36:
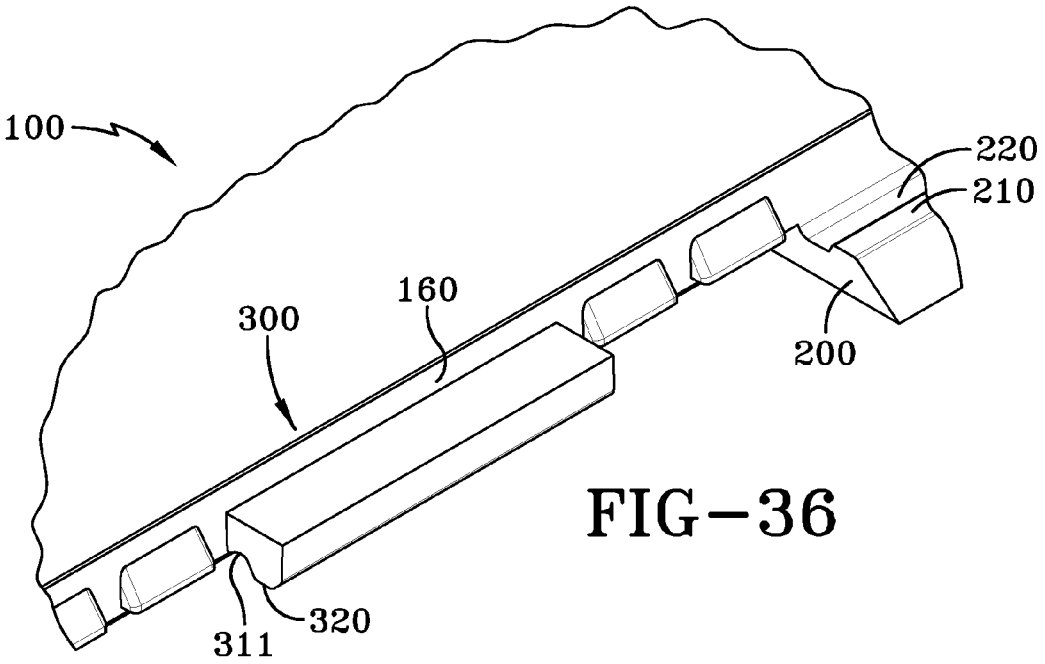
FIG. 36 shows an embodiment of the tray tabs with a downward tab having a convex surface.

Another embodiment as shown in FIG. 35, the upward tab 200 includes a convex surface 211 and a valley 220. As shown in FIG. 36, the downward tab 300 includes a concave surface 311 and a lip 320. As the downward tab 300 is urged against the upward tab 200, the downward tab 300 flexes as the lip 320 slides over the convex surface 211 and into the valley 220, such that the lip 320 snaps into the valley 220 and the concave surface 311 presses over the convex surface 211. This provides a connection with sufficient rigidity to create a composite floor made of multiple modular flooring assemblies 10.

Moreover, the interlocking connection between the downward tab 300 and the upward tab 200 may be separated such that the composite floor may be disassembled. This allows the user to change flooring as desired. Generally, the application of the modular flooring assemblies 10 will not harm the sub floor.

A right angle grout member 400 is shown in FIGS. 8-13. The grout member 400 includes a first leg 410 and a second leg 420. The first leg 410 and the second leg 420 are integrally connected at a right angle. Preferably, the grout member 400 is a single piece of material molded into its shape.

Figure 9:
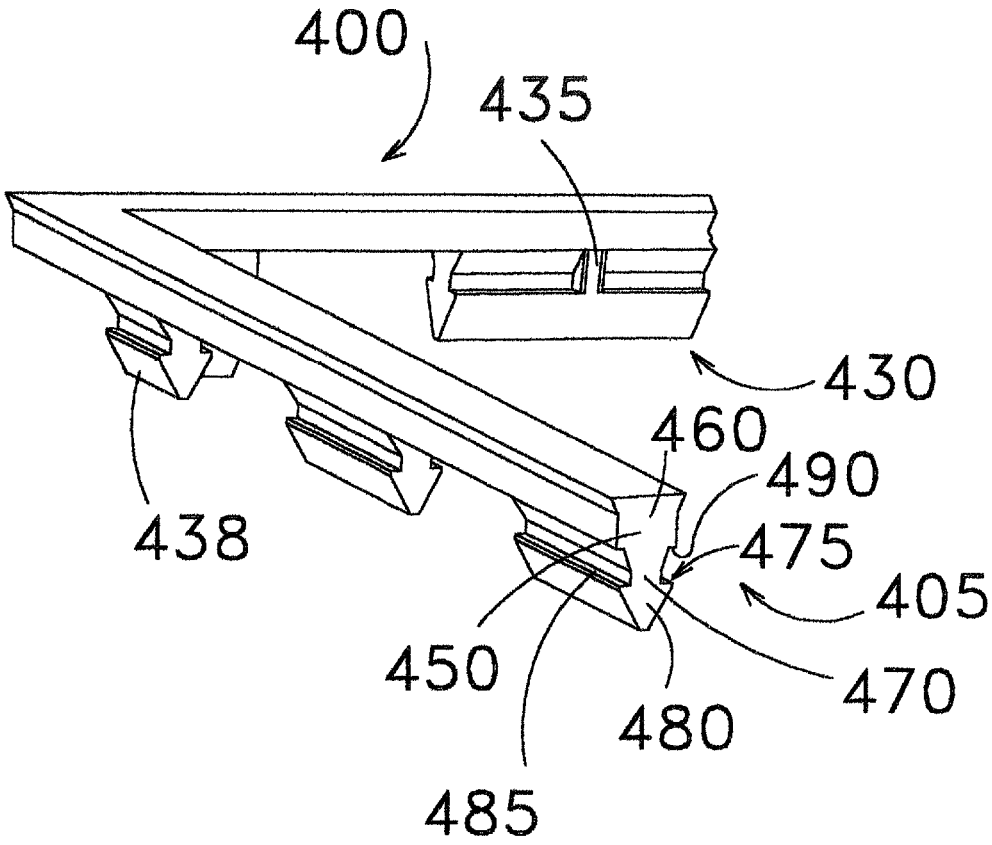
FIG. 9 shows a view another view of the end of the right-angle grout member.

Turning to FIG. 9, a view of one end 405 of the right angle grout member 400 is shown. The right angle grout member 400 includes a central portion 450. A fluted top 460 is the uppermost portion of the right angle grout member 400. The fluted top 460 provides a finished appearance to the installed modular floor. The fluted top 460 is complementary to the edges of the flooring component 600. An angled portion 480 connects to the central region by a narrow portion 470. The narrow portion 470 and the angled portion 480 form a groove 475. As the angled portion 480 is pushed into a grout slot 250 (partially shown in FIG. 7 and fully shown in FIG. 19), it slightly deforms and snaps into place with a top surface 485 of the angled portion 480 physically resting against a bottom surface 275 of the grout holder 270. This provides a secure connection for the right angle grout member 400 to the modular flooring assembly 10.

Figure 10:
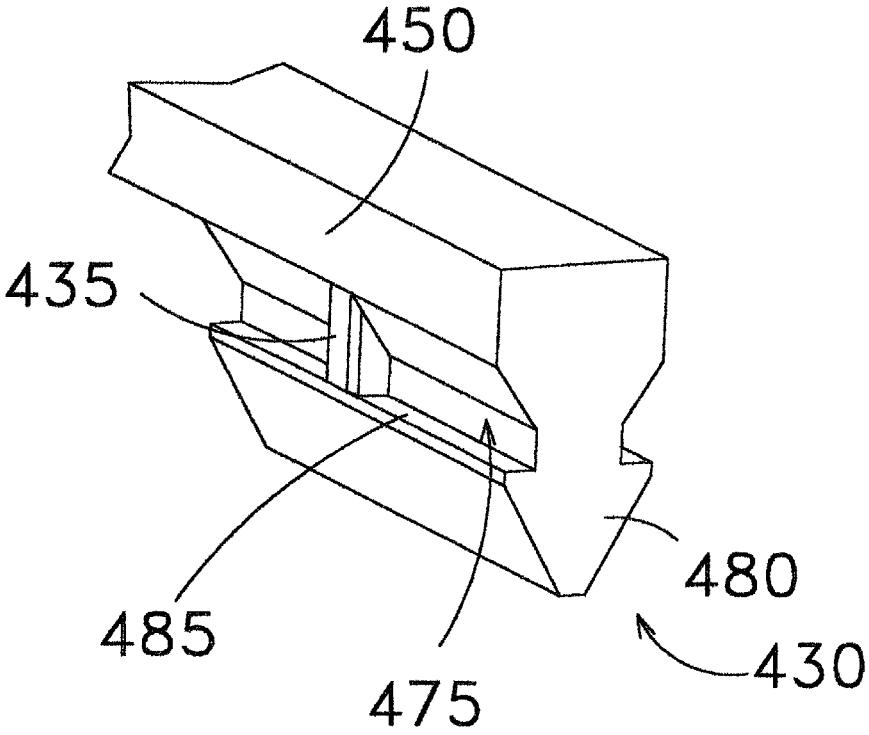
FIG. 10 shows a close-up view of the insert.

Both the first leg 410 and the second leg 420 include a plurality of inserts 430, which are received by the grout slots 250 formed by the combination of upward tabs 200, the downward tabs 300, and the grout holder 270. As shown in FIG. 10, the insert 430 includes an insert ridge 435 that cooperates with a grout holder 270 on the perimeter of the tray 100.

The tray 100 includes a plurality of the grout holders 270. The grout holders 270 are located between the alternating upwards tabs 200 and the downward tabs 300. The grout holders 270 generally have an angled shape that widens towards the bottom of tray 120.

The grout holders 270 receive the groove 475 formed by the grout member 400. The top surface 485 of the angled portion 480 rests against the bottom surface 275 of the grout holder 270.

In this embodiment, the grout holder 270 is separated into two sections by a grout holder separation 280 that receives the insert ridge 435 of the insert 430. This interaction between the insert ridge 435 and the grout holder separation 280 assists in stabilizing the grout member 400. This interaction allows the grout member 400 to be attached to the tray 100 before the tray 100 is connected to another tray 100. The insert ridge 435 and the grout holder separation 280 are optional features. A grout holder of a single component will provide satisfactory performance.

Figure 15:
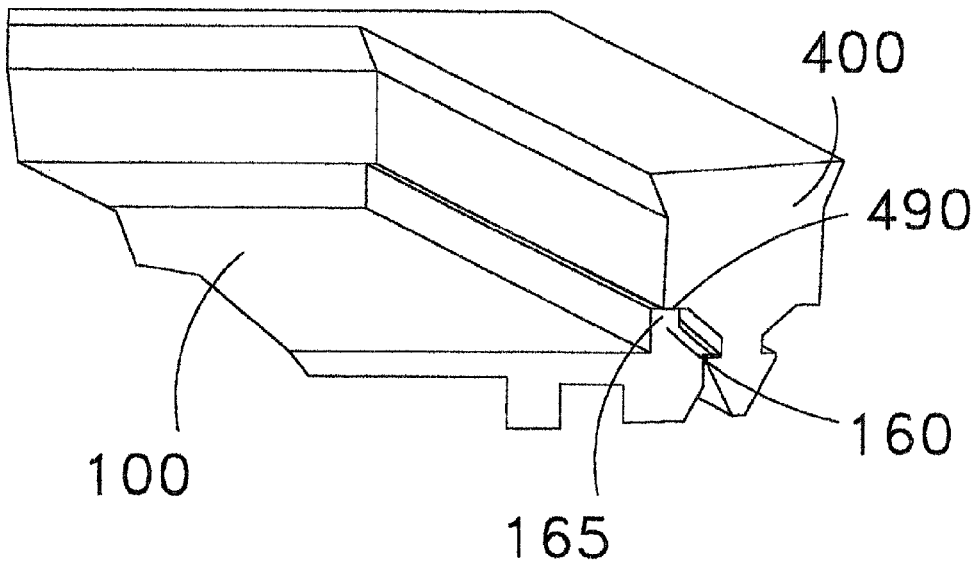
FIG. 15 shows a partial, side view of the right-angle grout member attached to the tray.

As shown in FIG. 15, the grout member 400 partially rests on top of the raised edges 160. Specifically, a rim 490 of the grout member 400 rests on a top edge 165 of the raised edges 160. Thus, the rim 490 resting on the top edge 165 resists a pulling force created by the top surface 485 urged against the bottom surface 275 of the grout holder. This interaction also provides a positive installation for the grout member 400. The grout member 400 is prevented from moving in a vertical or a horizontal plane.

A corner section 438 of the grout member 400 also interconnects to a corner grout holder 290 (shown in FIG. 2). In this embodiment, the corner grout holder 290 does not have an insert ridge 435. The corner grout holder assists in aligning the grout member 400.

Figure 11:
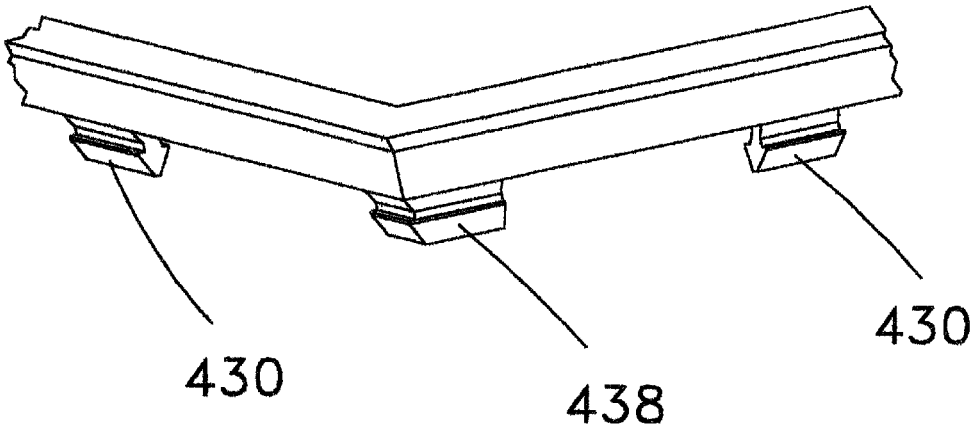
FIG. 11 shows an outside view of the corner of the right-angle grout member.
Figure 12:
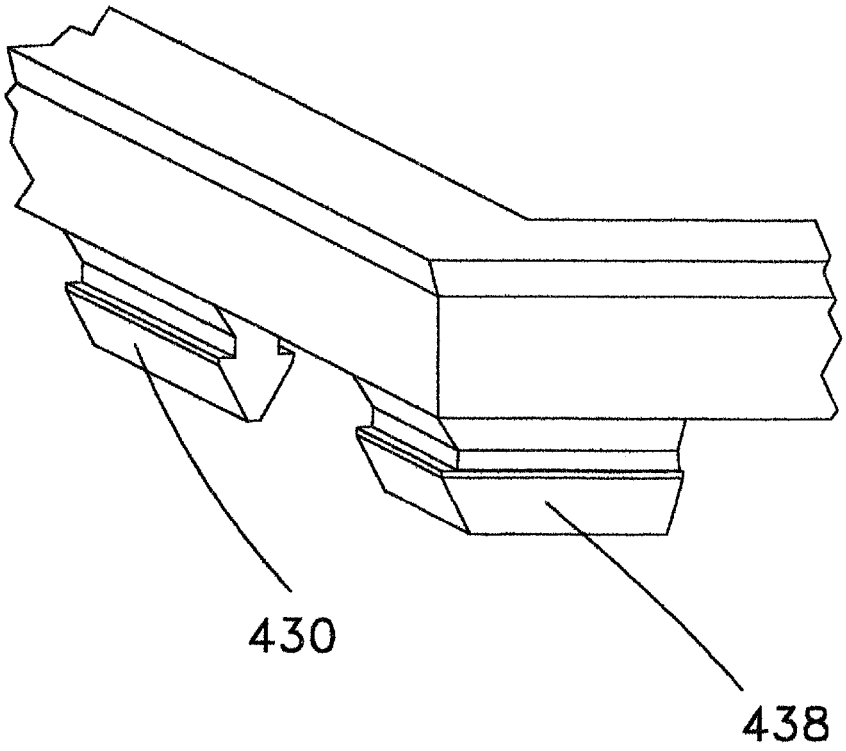
FIG. 12 shows a close-up view of the corner of the right-angle grout member.
Figure 13:
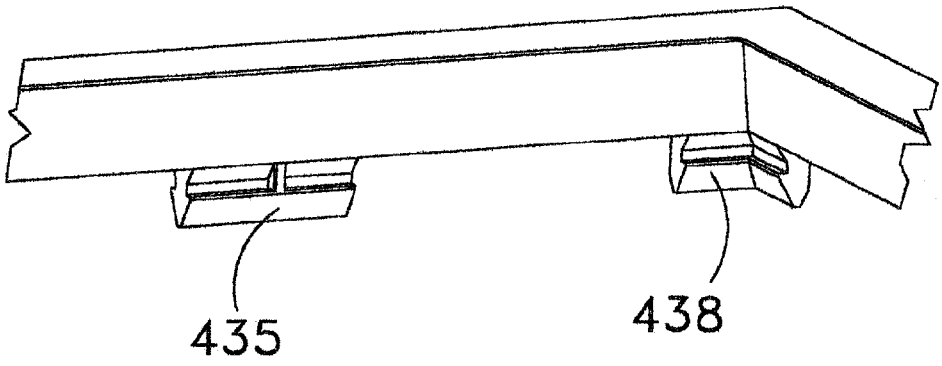
FIG. 13 shows an inside view of the corner of the right-angle grout member.

FIG. 11 shows an outside view of the right angle grout member 400 at the corner section. FIG. 12 shows a close-up, outside view of the corner section of the right angle grout member 400. FIG. 13 shows an inside view of the corner section of the right angle grout member 400.

Figure 14:
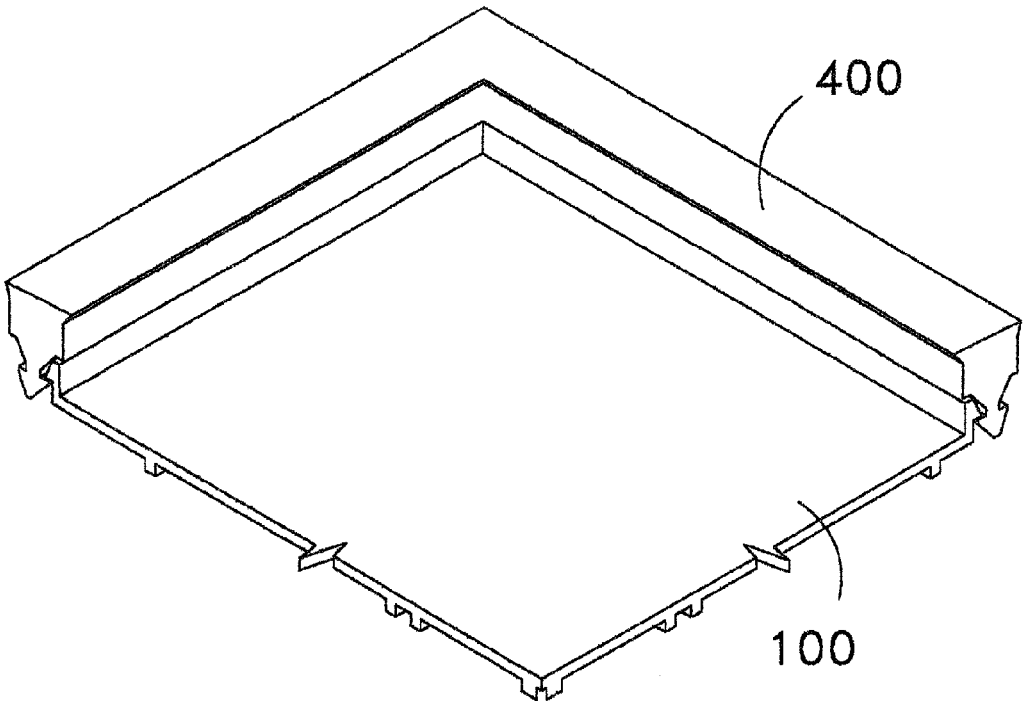
FIG. 14 shows a partial view of the right-angle grout member attached to the tray.

FIG. 14 shows a view of the right angle grout member 400 connected to the tray 100. In FIG. 14, the flooring component 600 is removed to show the connection between the right angle grout member 400 and the tray 100.

FIG. 15 shows the connection of the right angle grout 400 member to the tray 100.

Figure 16:
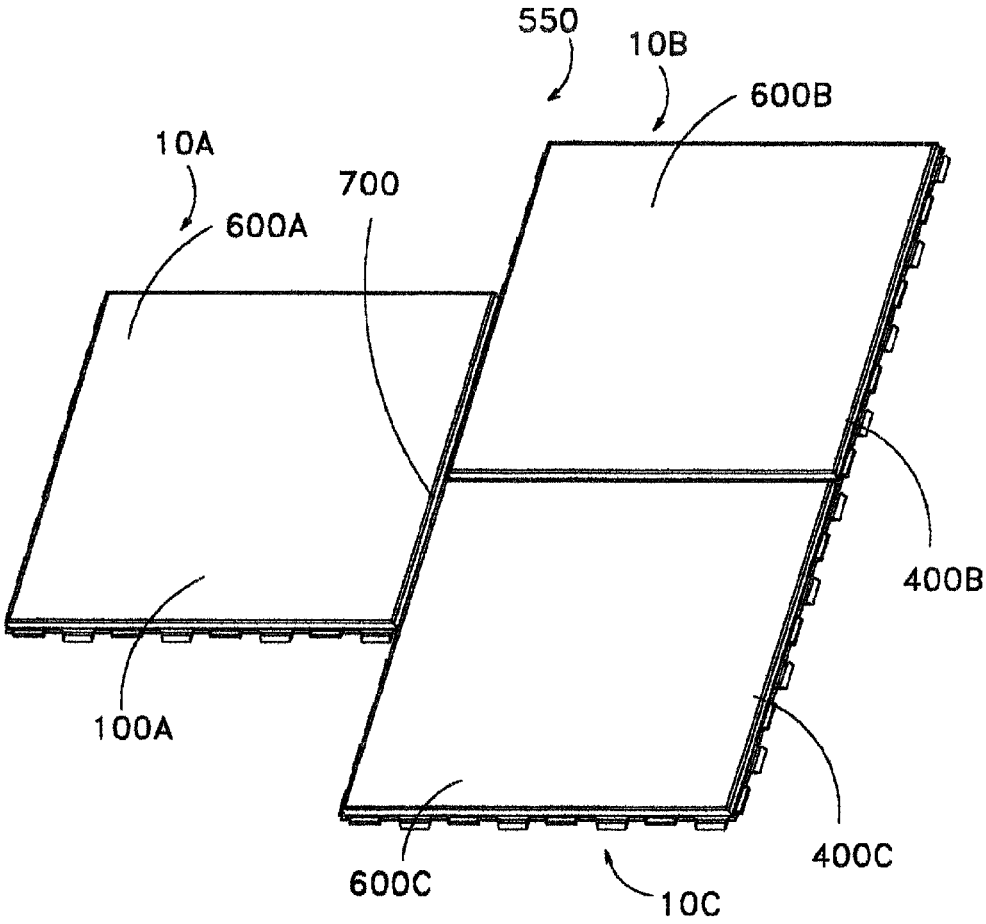
FIG. 16 shows a modular floor constructed of the modular flooring assemblies.

FIGS. 16-19 show various views of a modular floor 550. FIG. 16 shows the modular floor 550 including modular flooring assemblies 10(*a*), 10(*b*) and 10(*c*). In FIG. 16, there is no right angle grout member 400 shown installed around flooring component 600(*a*) in a channel 700. Modular flooring assembly 10(*c*) is shown with a flooring component 600(*c*) and a right angle grout member 400(*c*). A modular flooring assembly 10(*b*) is shown with a flooring component 600(*b*) and a right angle grout member 400(*b*).

Figure 17:
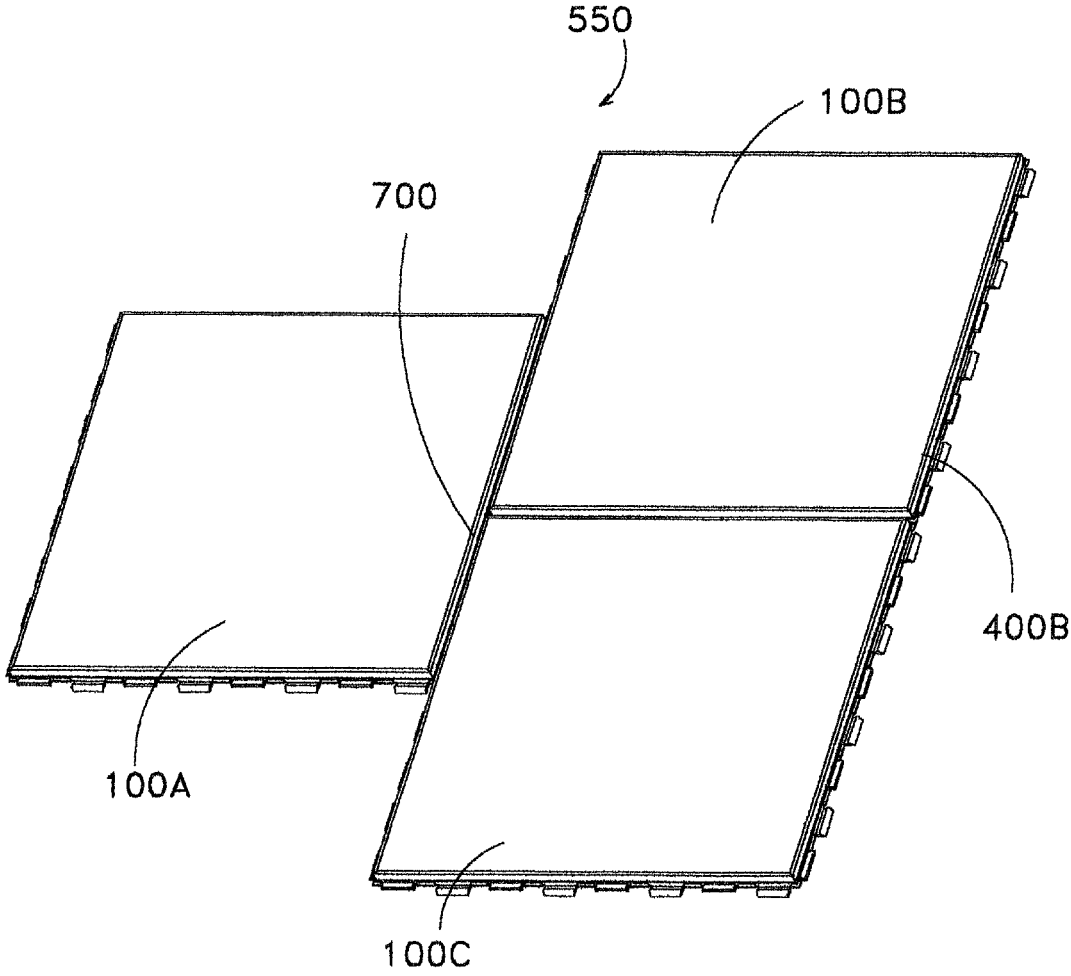
FIG. 17 shows a view of the modular floor with the flooring components removed.

In FIG. 17, the modular floor 550 is shown with the flooring component 600(*a*), 600(*b*), and 600(*c*) removed. The right angle grout member 400(*c*) is also removed.

Figure 18:
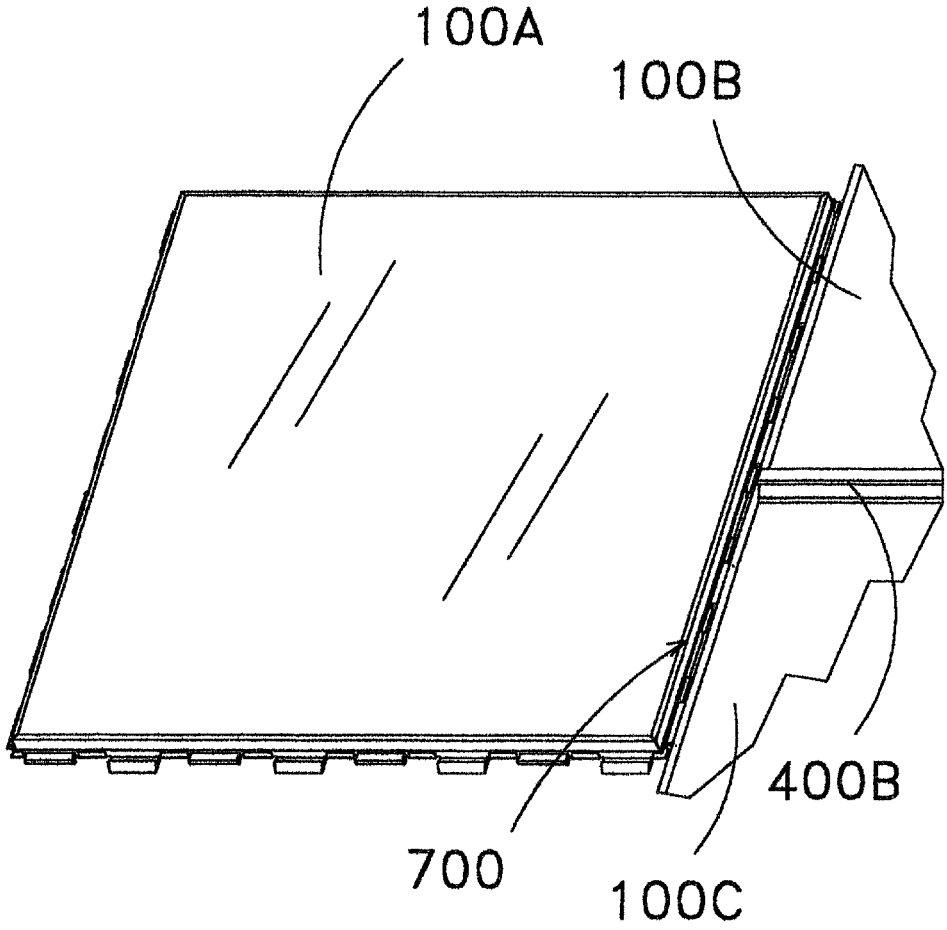
FIG. 18 shows a close-up view of the junction of the three modular flooring assemblies.

FIG. 18 shows a view of the junction of trays 100(*a*), 100(*b*), and 100(*c*). The right angle grout member 400(*b*) is shown.

Figure 19:
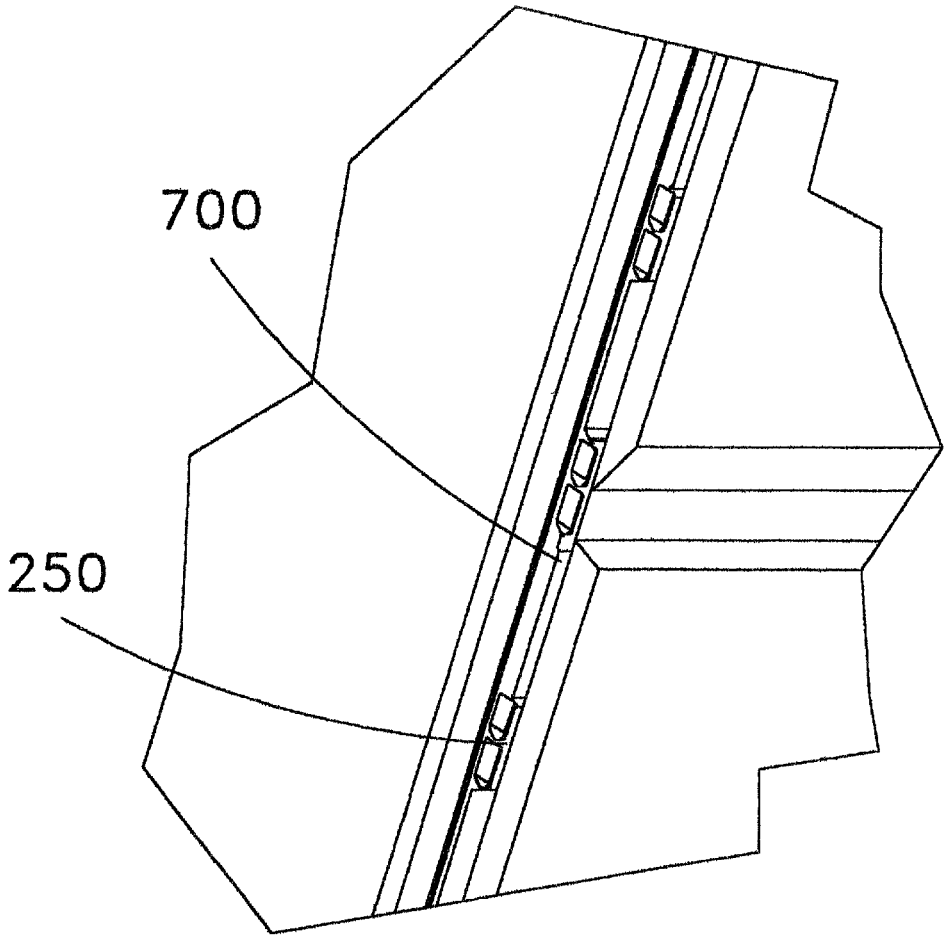
FIG. 19 shows another close-up view of the junction of the three modular flooring assemblies.

FIG. 19 is another view of the junction.

Figure 20:
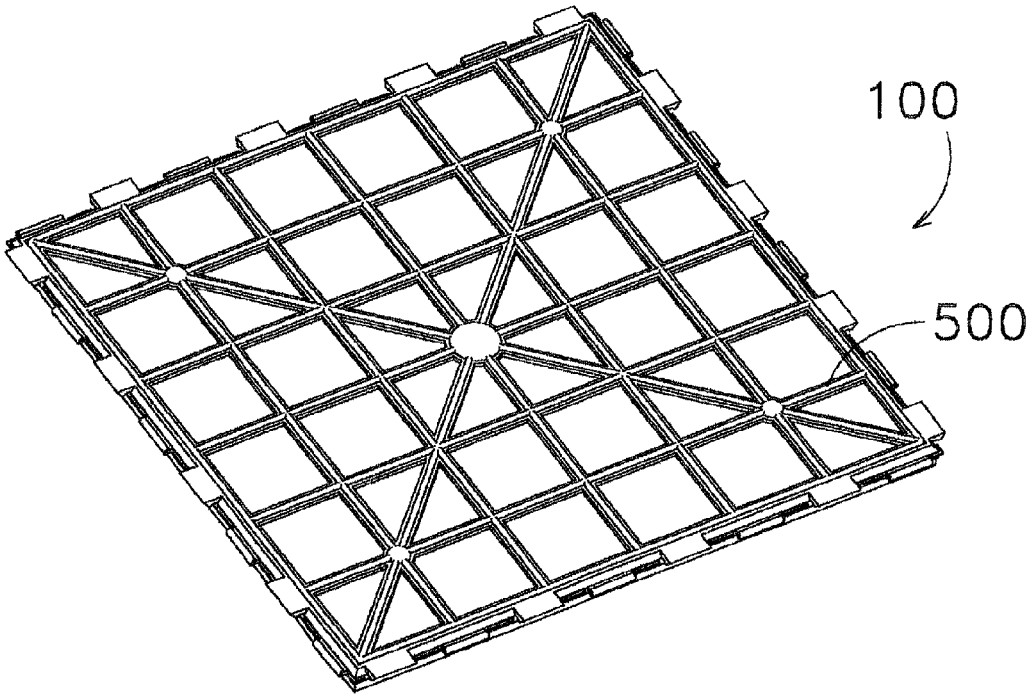
FIG. 20 shows a perspective view of the bottom of the tray with the padding in place.
Figure 21:
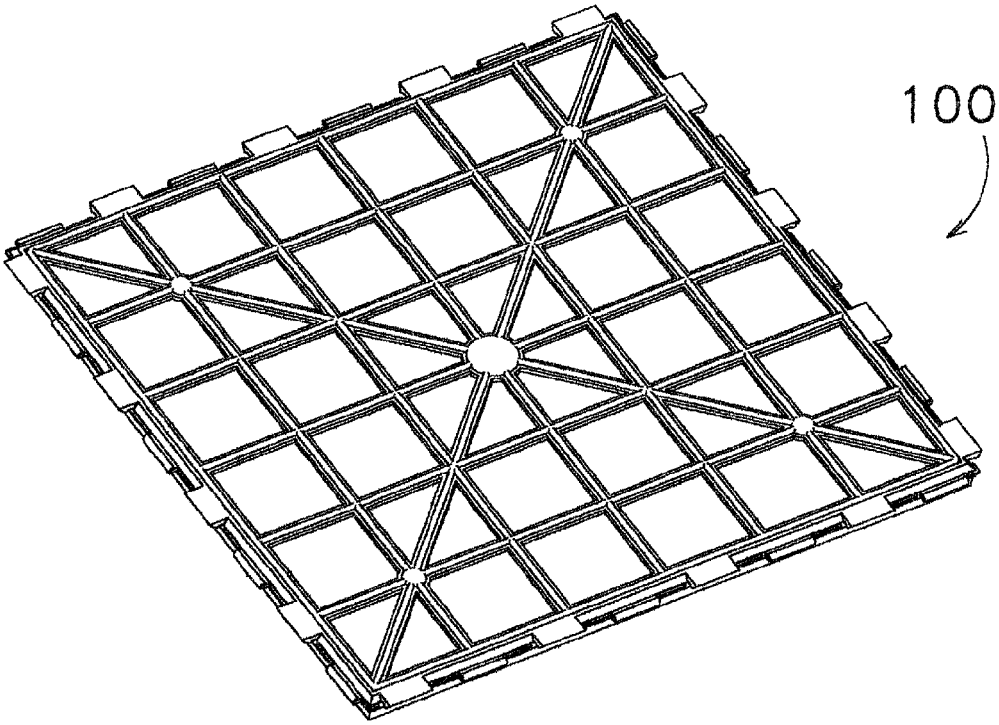
FIG. 21 shows a perspective view of the bottom of the tray with the padding removed.
Figure 22:
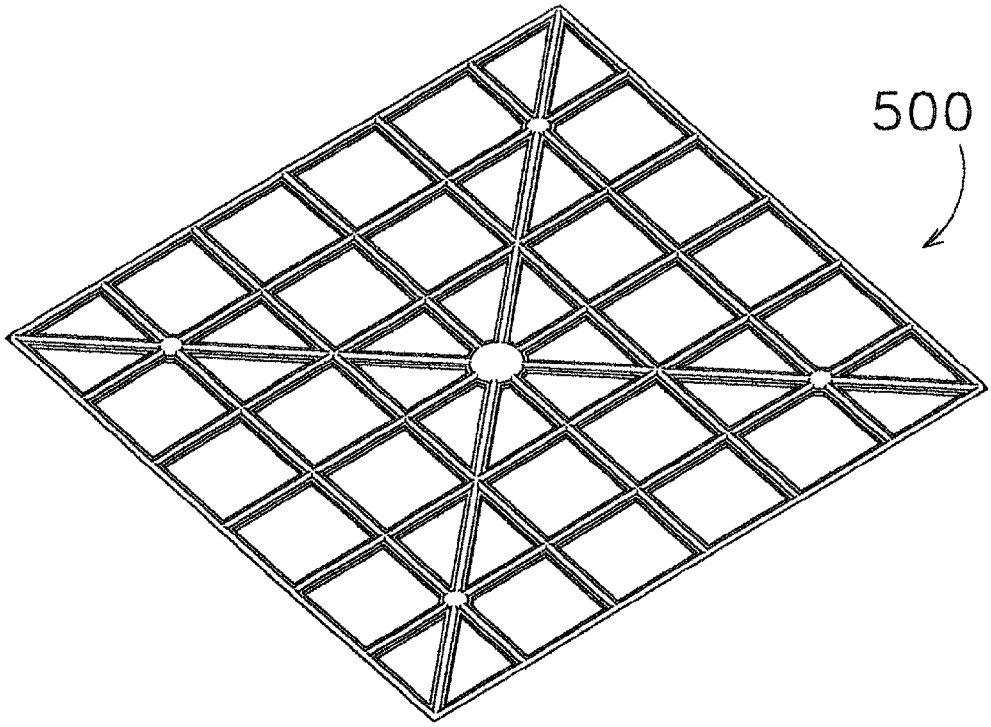
FIG. 22 shows a perspective view of the padding.

An optional padding 500 is shown in FIGS. 20 and 21. The padding 500 may be over-molded to the tray bottom 120. FIG. 21 shows the padding removed. The tray bottom 120 may include a series of channels. This provides a positive connection between the optional padding 500 and the tray bottom 120.

Figure 23:
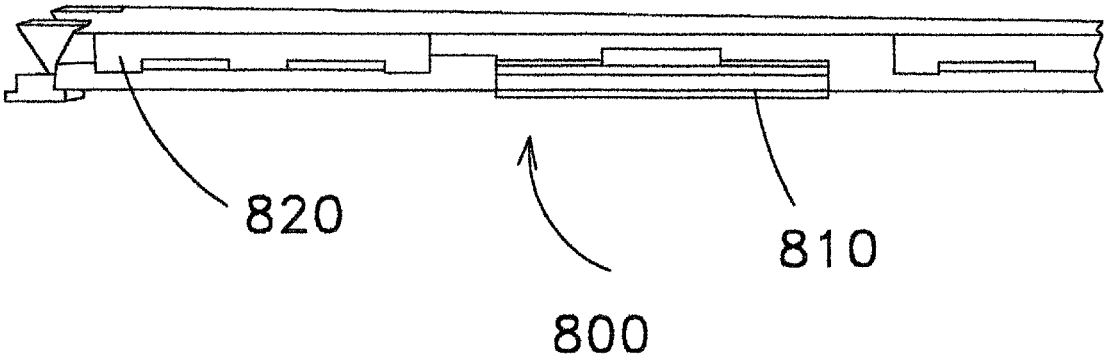
FIG. 23 shows a side view of the tray with grout holes.
Figure 24:
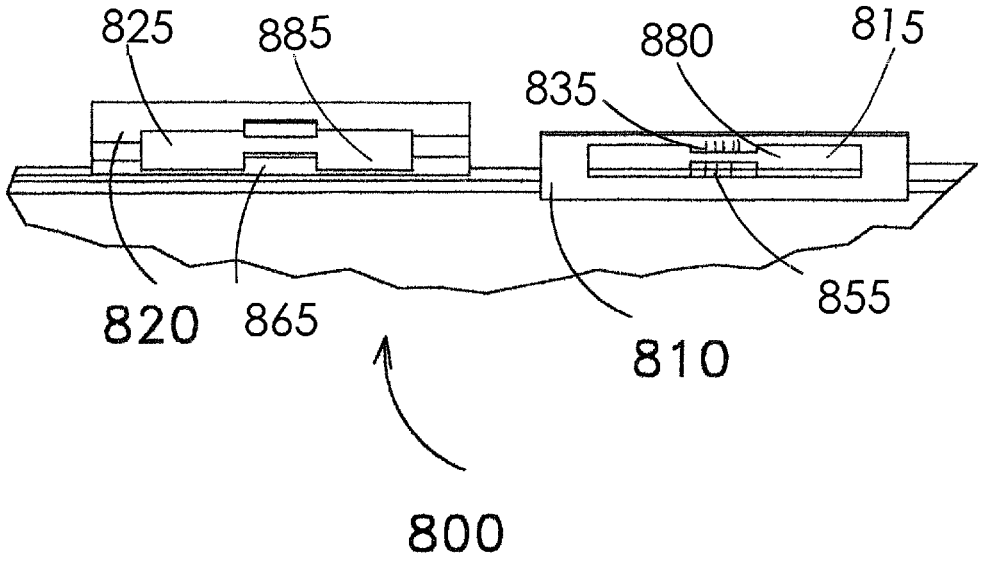
FIG. 24 shows a bottom view of the tray with grout holes.
Figure 25:
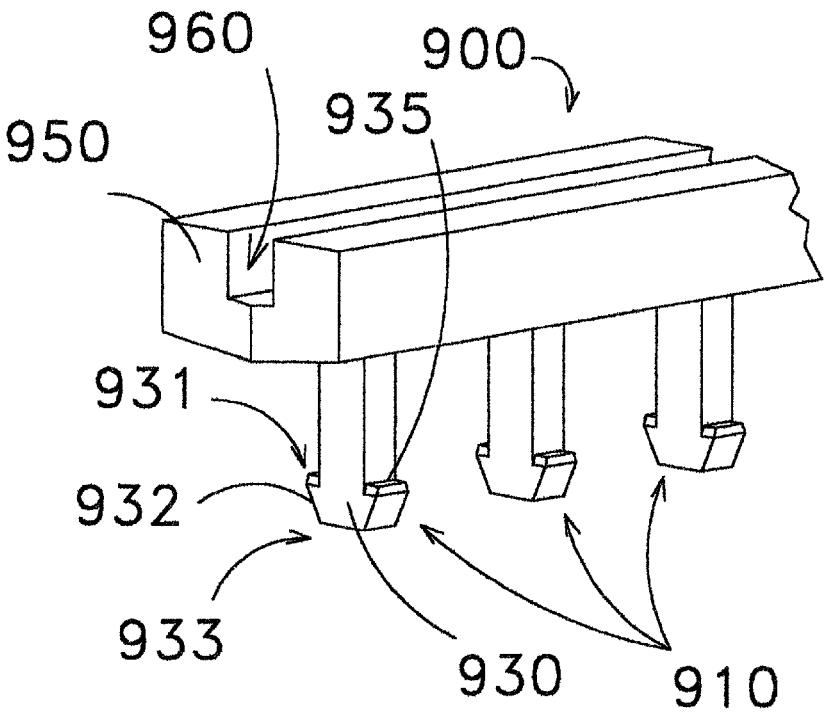
FIG. 25 show a perspective view of the grout for the tray with grout holes.
Figure 26:
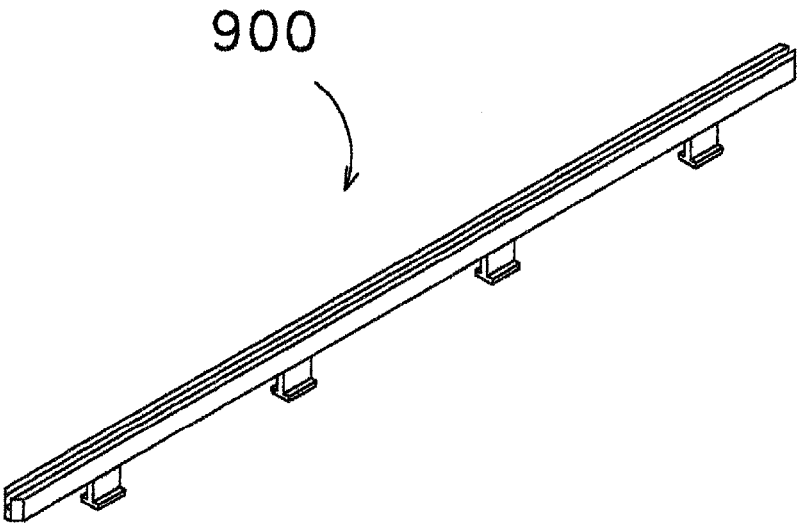
FIG. 26 shows another perspective view of the grout for the tray with grout holes.
Figure 27:
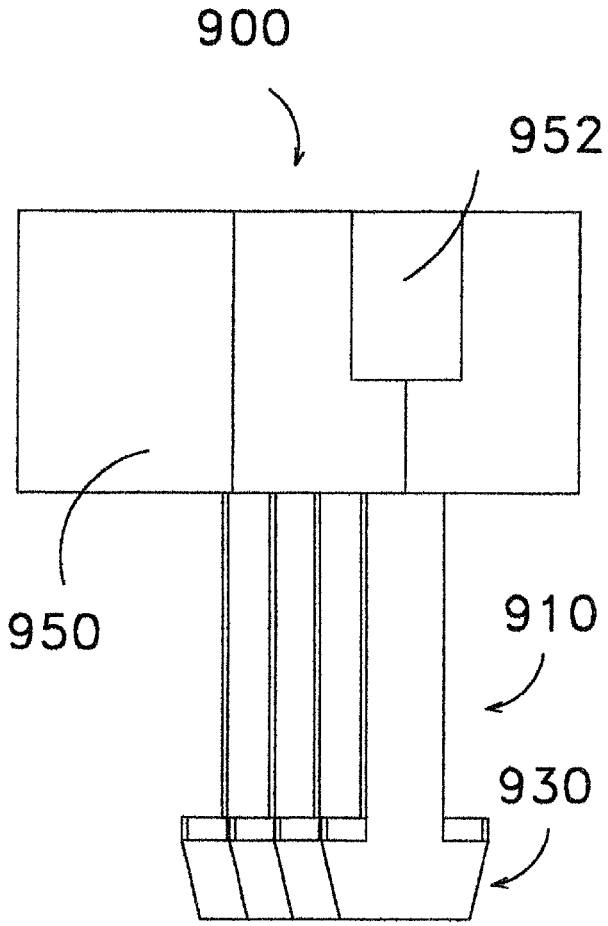
FIG. 27 shows an end view of the grout for the tray with grout holes.
Figure 28:
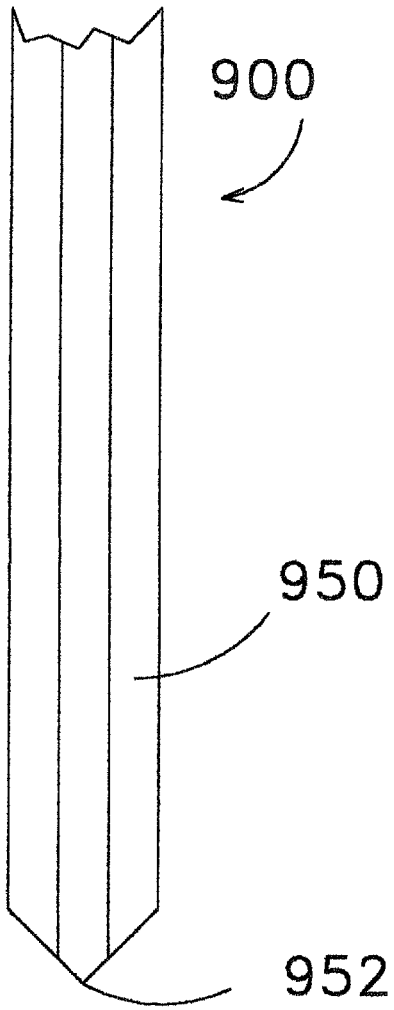
FIG. 28 shows a top view of the grout for the tray with grout holes.
Figure 29:
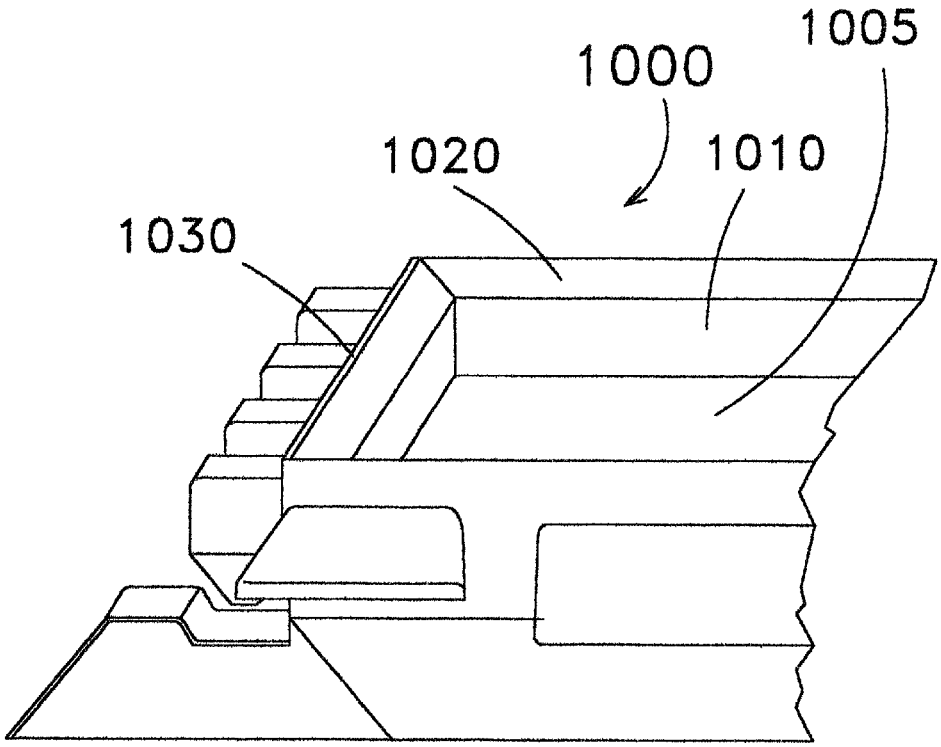
FIG. 29 shows a view of the tray substrate with the sloped vertical edges.
Figure 30:
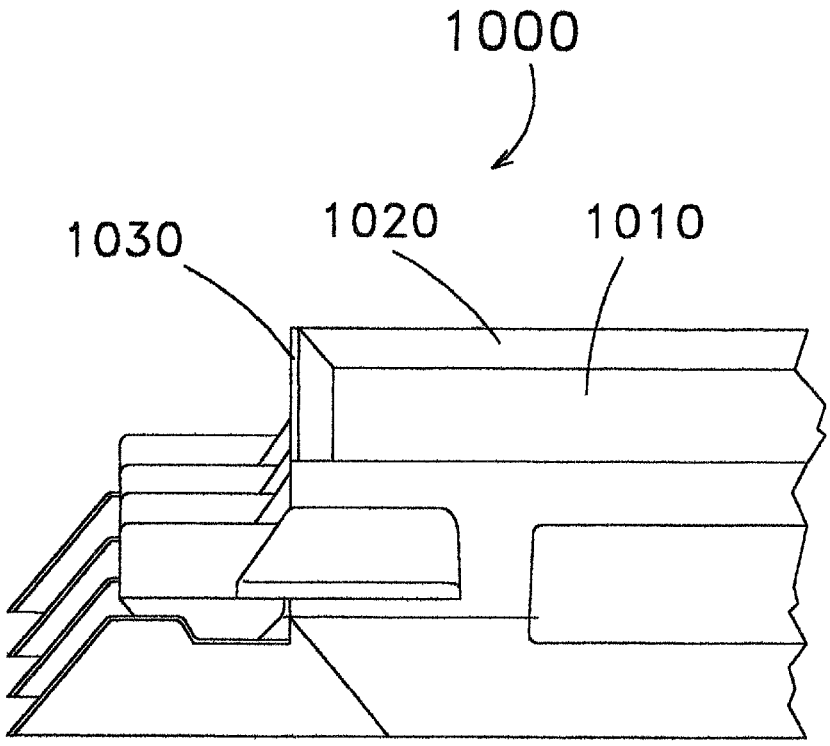
FIG. 30 shows another view of the tray substrate with the sloped vertical edges.
Figure 31:
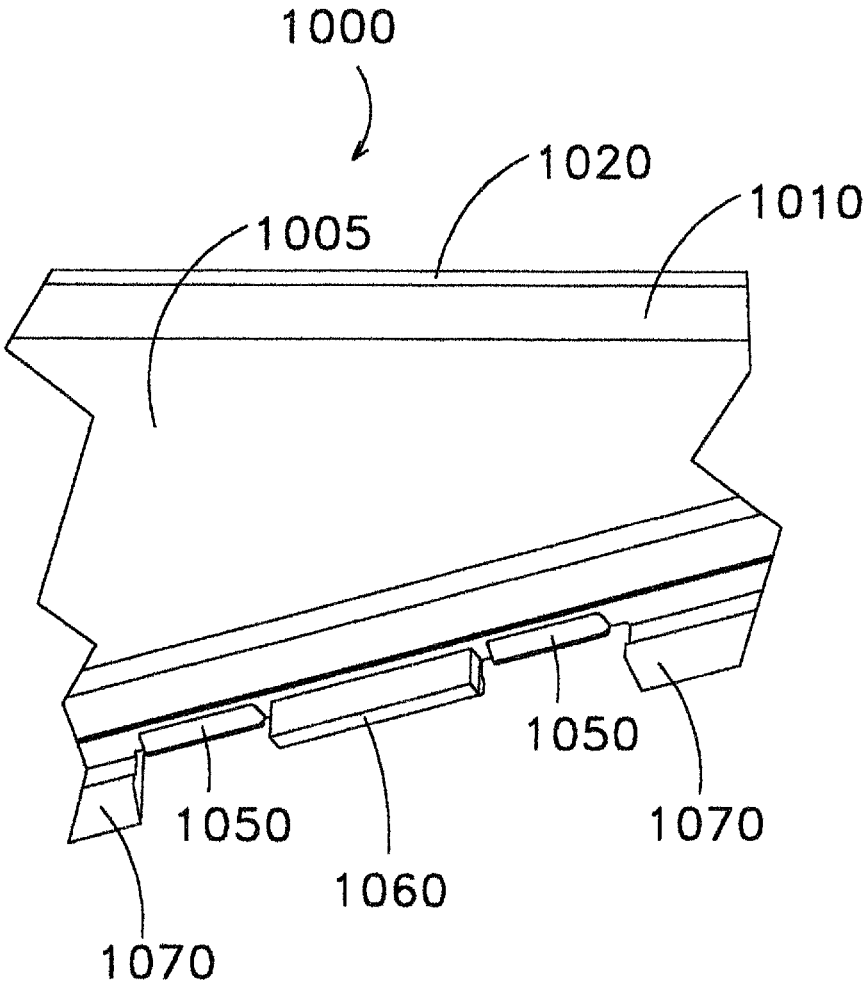
FIG. 31 shows a view of the upwards and the downwards tab of the tray with the sloped vertical edges.
Figure 32:
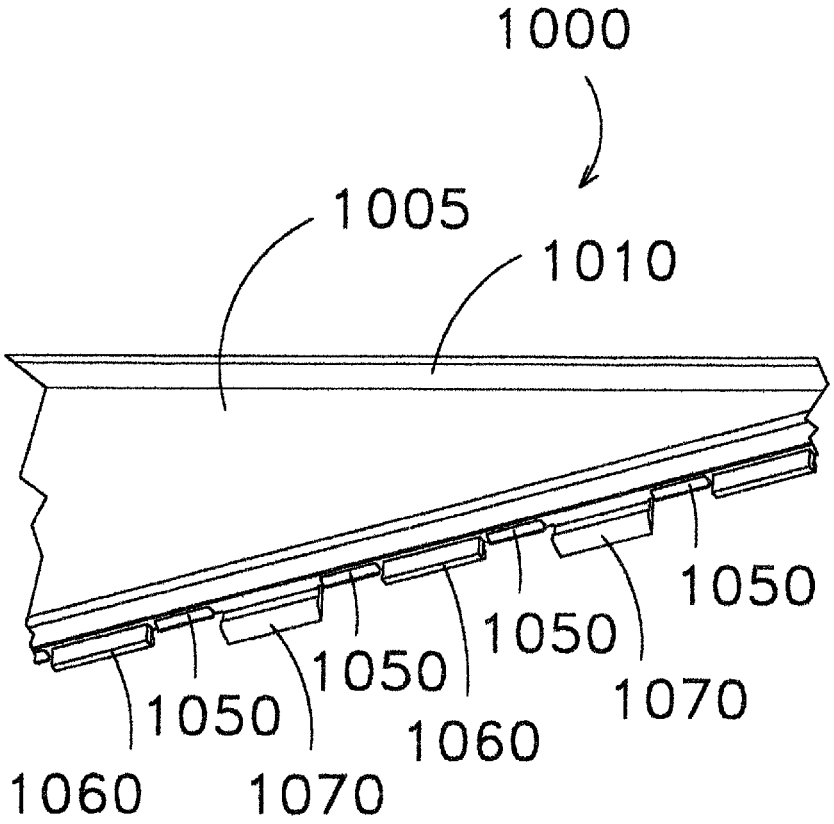
FIG. 32 shows another view of the upwards and the downwards tabs of the tray with the sloped vertical edges.

FIGS. 23-28 illustrate an embodiment in which snap-in grout is designed to fit into grout holes formed in the interlocking tabs. A tray 800 is shown in FIG. 23. The tray 800 interlocks with other trays 800 to form a modular floor. The tray 800 is shown without a flooring component. The tray 800 includes upward tabs 810 and downward tabs 820. The upward tabs 810 have grout holes 815. The downward tabs 820 have grout holes 825. When the upward tabs 810 and downward tabs 820 are interconnected, the grout holes 815 and the grout holes 825 overlap and provide a combined grout hole to receive a snap-in grout 900.

The snap-in grout 900 is shown in FIGS. 25-28. The snap-in grout 900 is locked into place with a slide locking mechanism. The snap-in grout 900 has a plurality of legs 910. The legs 910 expand into a barb portion 930. A top surface 931 of the barb portion 930 includes an optional serrated surface 935. The barb portion 930 is larger in cross-sectional area than the leg 910.

Sides 932 of the barb portion 930 are angled such that the barb portion 930 is pointed, i.e., a bottom surface 933 of the barb portion 930 is smaller than the top surface 931 of the barb portion 930. This snaps the barb portion into the combined grout hole and helps the barb portion 930 anchor the snap-in grout 900 into the combined grout hole. A bottom of the grout hole 815 has an optional serrated surface 835 matching to the serrated surface 935 on the snap-in grout 900.

The snap in grout 900 includes a grout portion 950 with a channel 960 to receive an additional grout member. The grout portion 950 ends in a point 952 formed by a 90 degree angle. When other grout portions 950 meet at an intersection of four modular flooring assemblies, the points 952 fill the intersection.

The periphery of the grout hole 815 includes a lower bracket region 855 and the periphery of the grout hole 825 includes an upper bracket region 865. The lower bracket region 855 and the upper bracket region 865 extend into the grout hole 815 and the grout hole 825, respectively. When the upward tabs 810 and downward tabs 820 are interconnected, the lower bracket region 855 and the upper bracket region 865 overlap. This provides a wider region 880 and 885 on either side of the overlapping bracket regions 855 and 865 that receives the barb portion 930. Then, the user laterally moves snap-in grout 930 until the barb portion 830 is underneath the overlapping lower bracket region 855 and the upper bracket region 865. Once the barb portion 930 is underneath, it is secured in place.

Another tray embodiment of the present invention is shown in FIGS. 29-32. A tray 1000 is illustrated with vertical edges 1010 rising from a bottom surface 1005 from the tray 1000. The vertical edges 1010 extend around the entire perimeter of the tray 1000. The vertical edges 1010 have a sloped surface 1020.

The sloped surface 1020 angles inward and downward, i.e. toward a middle of the bottom surface 1005. The sloped surface 1020 provides several advantages. First, the sloped surface 1020 creates an adhesive moat to capture any excess adhesive. When a flooring component is pressed into the tray 1000, the adhesive has a place to pool, which improves the bond between the flooring component and the tray 1000, and further reduces the likelihood that the adhesive will spill over the vertical edge 1010 and contaminate the interlocking tabs. The sloped surface 1020, due to its inward and downward edge, also helps guide the flooring component into the tray 1000 during assembly.

The vertical edge 1010 also includes a generally flat upper surface 1030 that transitions into the sloped surface 1020. The grout member may rest on the upper surface 1030.

In this embodiment, the tray 1000 includes grout holders 1050. The grout holders 1050 are a solid body without the grout holder separation as shown in some of the other embodiments of the present invention. The grout holder 1050 is positioned between downward tabs 1060 and upward tabs 1070.

Figure 33:
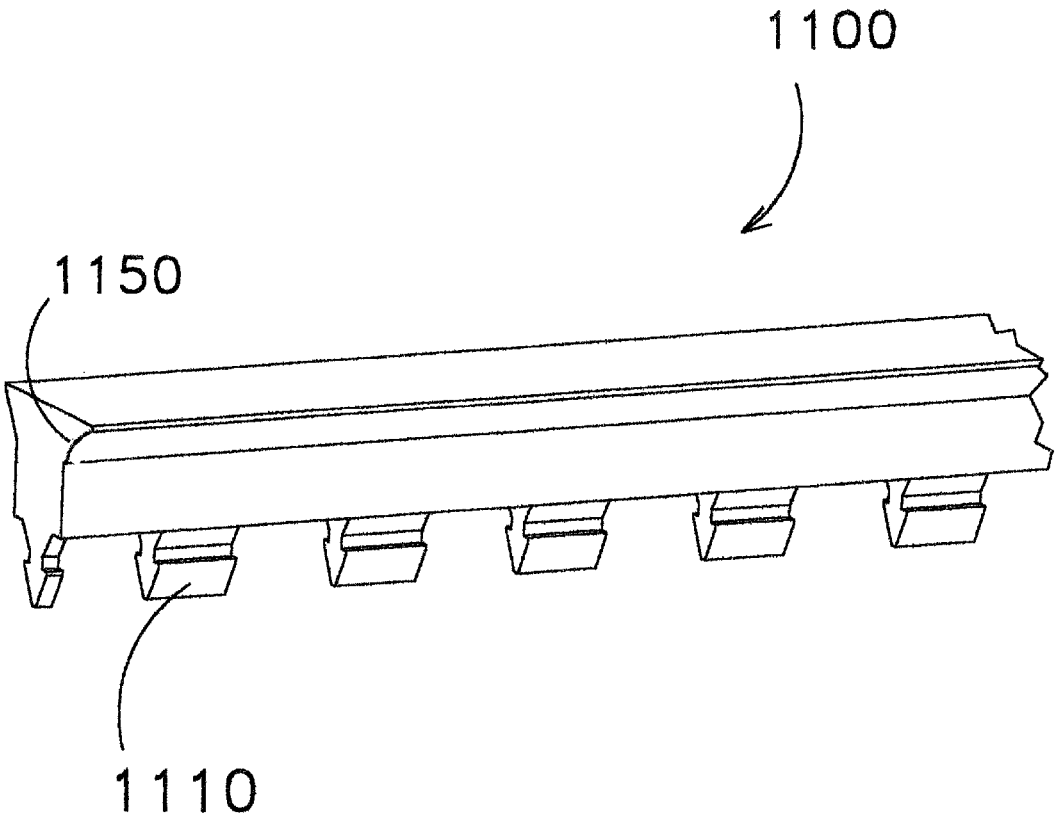
FIG. 33 shows another end view of the right-angled member with the curved transition.

FIG. 33 shows another right-angle grout member of the present invention. A right-angle grout member 1100 includes a curved transition 1150. The curved transition 1150 provides a compressible seal that is forgiving to the edge of the flooring component. The right angle grout member 1100 further includes inserts 1110 that lack the insert ridge 435 of other embodiments of the present invention. The inserts 1110 provide sufficient connectivity between the inserts 1110 and the interlocking trays with reduced manufacturing and production costs.

Figure 34:
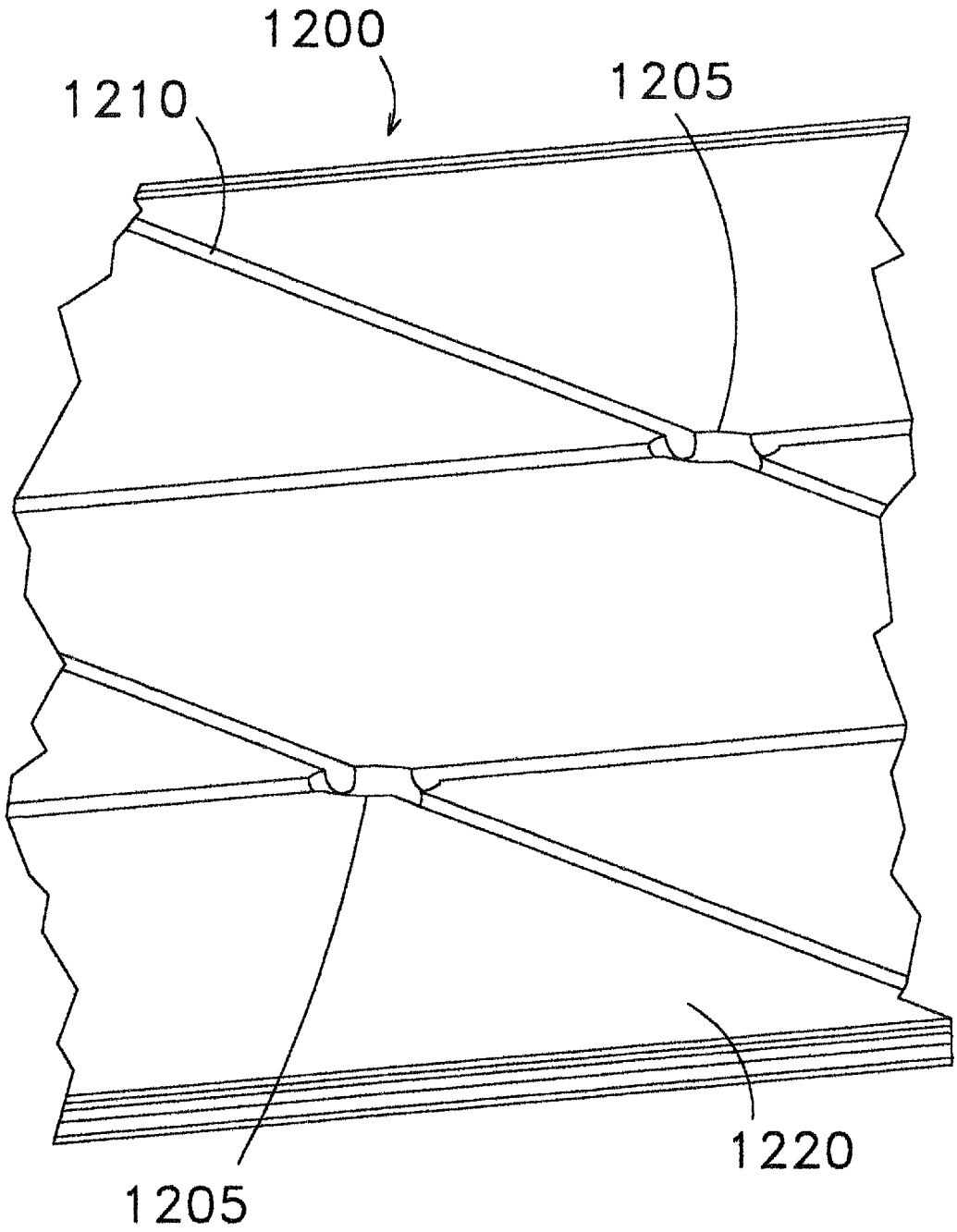
FIG. 34 shows another view of the flooring component having grooves and depressions.

FIG. 34 shows a flooring component 1200 of the present invention. The flooring component 1200 is a ceramic tile having depressions 1205 and grooves 1210 therein. A bottom surface 1220 of the flooring component 1200 is shown. By including the depressions 1205 and the grooves 1210, the adhesive is provided more surface area to contact the flooring component 1200. Further, joint starvation is reduced since adhesive is not squeezed away from regions of the bottom surface 1220 of the flooring component 1200. If the bottom of the flooring component 1200 includes ridges or protrusions, then adhesive may be pushed away in from these areas leading to joint starvation resulting in an inferior bond between the bottom of the flooring component and the surface of the tray.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the present invention.

We claim:

1. A modular flooring assembly kit comprising two or more flooring system components capable of being assembled wherein each of the two or more flooring system components comprises:

a flooring component, an adhesive, a tray substrate having a tray substrate surface which is an upward facing horizontal surface, a tray substrate bottom with a padding attached to the tray substrate bottom, a plurality of tray substrate vertical tray edges which protrude upward and extend around a perimeter of the tray substrate surface, a plurality of tray substrate edges defining an outside perimeter of the tray substrate, the tray substrate edges having a plurality of upward tabs and downward tabs with the upward tabs and the downward tabs extending alternatively from the plurality of the tray substrate edges, wherein the upward tabs each have a convex surface and a valley, and the downward tabs each have a concave surface and a lip, wherein the flooring component is smaller than a tray surface defined by the stray substrate vertical edges and said flooring component is adhered to the tray substrate surface with the adhesive, and the upward tabs of one of the two or more flooring system components is adapted to interact with the downward tab of a second of the two or more flooring system components.

2. The modular flooring assembly kit of claim 1, wherein the flooring component is selected from the group consisting of tile, stone, marble, wood, ceramic tile, porcelain tile, and granite.

3. The modular flooring assembly kit of claim 1, wherein the tray substrate vertical tray edges run the entire perimeter of the tray substrate surface.

4. The modular flooring assembly kit of claim 3, wherein the flooring component is selected from the group consisting of tile, stone, marble, wood, ceramic tile, porcelain tile, and granite.

5. The modular flooring assembly kit of claim 1, wherein the upward and downward tabs have grout holes.

6. The modular flooring assembly kit of claim 5, wherein the flooring component is selected from the group consisting of tile, stone, marble, wood, ceramic tile, porcelain tile, and granite.

7. The modular flooring assembly kit of claim 5, wherein the tray substrate vertical tray edges run the entire perimeter of the tray substrate surface.

8. The modular flooring assembly kit of claim 6, wherein the tray substrate vertical tray edges run the entire perimeter of the tray substrate surface.

9. A flooring component system kit capable of being assembled comprising a flooring component, an adhesive, a tray substrate having a tray substrate surface which is an upward facing horizontal surface, a tray substrate bottom with a padding attached to the tray substrate bottom, a plurality of tray substrate vertical tray edges which protrude upward and extend around a perimeter of the tray substrate surface, a plurality of tray substrate edges defining an outside perimeter of the tray substrate, the tray substrate edges having a plurality of upward tabs and downward tabs with the upward tabs and the downward tabs extending alternatively from the plurality of the tray substrate edges, wherein the upward tabs each have a convex surface and a valley, and the downward tabs each have a concave surface and a lip, wherein the flooring component is smaller than a tray surface defined by the tray substrate vertical edges, the flooring component is adapted to be fitted onto the upward facing horizontal surface, and the flooring component is adapted to be adhered to the upward facing surface with the adhesive.

10. The flooring component system kit of claim 9, wherein the flooring component is selected from the group consisting of tile, stone, marble, wood, ceramic tile, porcelain tile, and granite.

11. The flooring component system kit of claim 9, wherein the tray substrate vertical tray edges run the entire perimeter of the tray substrate surface.

12. The flooring component system kit of claim 11, wherein the flooring component is selected from the group consisting of tile, stone, marble, wood, ceramic tile, porcelain tile, and granite.

13. The flooring component system kit of claim 9, wherein the upward and downward tabs have grout holes.

14. The flooring component system kit of claim 13, wherein the flooring component is selected from the group consisting of tile, stone, marble, wood, ceramic tile, porcelain tile, and granite.

15. The flooring component system kit of claim 14, wherein the tray substrate vertical tray edges run the entire perimeter of the tray substrate surface.

16. The flooring component system kit of claim 13, wherein the tray substrate vertical tray edges run the entire perimeter of the tray substrate surface.

* * * * *